US006333490B1

(12) United States Patent
Higashi et al.

(10) Patent No.: US 6,333,490 B1
(45) Date of Patent: Dec. 25, 2001

(54) TONER IMAGE FIXING APPARATUS CAPABLE OF KEEPING CONSTANT FIXING ROLLER TEMPERATURE

(75) Inventors: Yuichiro Higashi; Yasuhide Hamada, both of Tokyo (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/660,075

(22) Filed: Sep. 11, 2000

Related U.S. Application Data

(63) Continuation of application No. 09/266,017, filed on Mar. 11, 1999, now Pat. No. 6,181,891.

(30) Foreign Application Priority Data

Jun. 1, 1998 (JP) ..... 10-165849
Jun. 1, 1998 (JP) ..... 10-165850
Jun. 1, 1998 (JP) ..... 10-165851

(51) Int. Cl.[7] ..... H05B 1/00

(52) U.S. Cl. ..... 219/216; 219/469; 399/69; 399/330; 399/334; 355/285

(58) Field of Search ..... 219/216, 469, 219/470, 471; 118/60; 399/330, 331, 332, 333, 334, 335, 328, 329, 336, 337, 338; 432/69, 60, 228; 492/46; 355/282, 286, 285, 290

(56) References Cited

U.S. PATENT DOCUMENTS 5,041,718 8/1991 d'Hondt et al. ..... 219/255
5,047,809 * 9/1991 Owada et al. ..... 355/284
5,075,732 12/1991 Menjo ..... 355/282
5,465,146 * 11/1995 Higashi et al. ..... 355/285
5,512,993 * 4/1996 Endo et al. ..... 355/285
5,671,462 9/1997 Toyohara et al. ..... 399/33
5,819,134 * 10/1998 Sato et al. ..... 399/69
5,822,670 * 10/1998 Morigami ..... 399/334

FOREIGN PATENT DOCUMENTS 5-27620 2/1993 (JP) .
5-80666 4/1993 (JP) .
7-319321 12/1995 (JP) .

* cited by examiner

*Primary Examiner*—Teresa Walberg
*Assistant Examiner*—Shawntina Fuqua
(74) *Attorney, Agent, or Firm*—Armstrong, Westerman, Hattori, McLeland & Naughton, LLP

(57) ABSTRACT

A toner image fixing apparatus has a fixing roller, a pressing roller, and a heating roller. The pressing roller is normally urged toward the fixing roller for pressing a sheet with an unfixed toner image carried on a surface thereof against the fixing roller to fix the unfixed toner image to the sheet when the sheet passes in one direction through a rolling contact region between the fixing roller and the pressing roller. The heating roller is disposed on one side of the fixing roller opposite to the pressing roller. A first heat source is disposed in the heating roller for heating the heating roller, and a second heat source is disposed in the pressing roller for heating the pressing roller. An endless heat transfer belt is trained around the heating roller and the fixing roller for transferring heat from the first heat source to heat the unfixed toner image on the sheet when the sheet passes through the rolling contact region. When the apparatus is in a standby mode, a controller energizes the first heat source and the second heat source. When the apparatus is in the sheet feed mode, the controller energizes the first heat source, and also energizes the second heat source only if the sheet is of a size larger than a predetermined size.

18 Claims, 16 Drawing Sheets

TONER IMAGE FIXING APPARATUS CAPABLE OF KEEPING CONSTANT FIXING ROLLER TEMPERATURE

This application is a Continuation of application Ser. No. 09/266,017, filed Mar. 11, 1999 which is now U.S. Pat. No. 6,181,891, issued Jan. 30, 2001.

BACKGROUND OF THE INVENTION

1. Field of the Invention

The present invention relates to an apparatus for and a method of fixing a toner image to a recording medium by fusing and pressing the toner image to the recording medium in an image forming system such as a copying machine, a printer, a facsimile machine, etc.

2. Description of the Related Art

FIG. 14 of the accompanying drawings shows a conventional recent toner image fixing apparatus for use in electrophotographic machines. As shown in FIG. 14, the toner image fixing apparatus has a belt fixing system comprising a fixing roller R1, a heating and tensioning roller R3, an endless fixing belt B trained around the rollers R1, R3, and a pressing roller R2 disposed below and pressed against the fixing roller R1 with the fixing belt B interposed therebetween. When a recording medium D in the form of a sheet with an unfixed toner image carried thereon is fed into the toner image fixing apparatus by a sheet feeder, the recording medium D is reheated by the heating and tensioning roller R3, and then the toner image is fixed to the recording medium D by the fixing belt B in a nipping region between the rollers R1, R2. Since the recording medium D is preheated, the nipping region may be set to a relatively low temperature. The fixing belt B is of such a small heat capacity that when the recording medium D passes through the nipping region, the temperature of the fixing belt B is quickly lowered to increase the coherent ability of the toner which is separated from the fixing belt B at the outlet of the nipping region, for thereby allowing the toner to be easily separated from the fixing belt B. Even if the fixing belt B is free of oil or coated with a small amount of oil, a clear fixed toner image can be produced on the recording medium D without offsets. The toner image fixing apparatus shown in FIG. 14 is thus capable of solving the problems of toner separation and oil coating, which have not been eliminated by other toner image fixing apparatus using only a heating roller.

The conventional toner image fixing apparatus shown in FIG. 14 will be described in greater detail. The pressing roller R2 is positioned directly beneath the fixing roller R1, and the heating and tensioning roller R3 is disposed upstream of the fixing roller R1 with respect the direction in which the recording medium D is fed into the toner image fixing apparatus along the fixing belt B that is trained around the rollers R1, R3.

The toner image fixing apparatus also has an oil coating roller R4 disposed above an upper run of the fixing belt B. A guide plate G for supporting the recording medium D is disposed below a lower run of the fixing belt B, and a gap between the guide plate G and the lower run of the fixing belt B serves as a preheating passage P for preheating the recording medium D when the recording medium D travels below the heating and tensioning roller R3 toward the nipping region.

The fixing belt B is tensioned to a desired tension level when the heating and tensioning roller R3 is pushed away from the fixing roller R1 by a pressing lever U. The fixing belt B is actuated by the fixing roller R1 which is coupled to an actuator. Since the fixing belt B is appropriately tensioned, it can stably rotate around the rollers R1, R3 without undesirable slippage and sagging.

A heater H is housed in the heating and tensioning roller R3. The heating and tensioning roller R3 is associated with a thermistor S for measuring the temperature of the surface of the heating and tensioning roller R3. The fixing belt B on the heating and tensioning roller R3 has a sheet-contact area which is contacted by the recording medium D that is fed from the sheet feeder and a non-sheet-contact area which is not contacted by the recording medium D that is fed from the sheet feeder. The thermistor S is kept out of contact with the sheet-contact area of the fixing belt B on the heating and tensioning roller R3, but held in contact with the non-sheet-contact area of the fixing belt B on the heating and tensioning roller R3.

During the fixing process, based on a signal from the thermistor S, a controller (not shown) connected to the thermistor S controls the amount of heat generated by the heating and tensioning roller R3 so that the temperature of the surface of the heating and tensioning roller R3 will be kept at a preset level.

The temperature of the fixing belt B on the fixing roller R1 varies depending on the period of time in which the fixing belt B has rotated, and is not constant when the recording medium D passes through the nipping region. If the period of time in which the fixing belt B has rotated is short, then the temperature of the fixing belt B on the fixing roller R1 is low. In order to increase the temperature of the fixing belt B on the fixing roller R1, it is necessary to increase a temperature setting for the heating and tensioning roller R3 for thereby bringing the temperature of the fixing belt B on the fixing roller R1 into a toner image fixing temperature range at all times.

If the toner image fixing apparatus shown in FIG. 14 is used to produce successive full-color copies, since the period of time in which the fixing belt B has rotated increases, the temperature of the fixing belt B on the fixing roller R1 also increases, and so does the temperature of the outlet of the nipping region. FIG. 15 of the accompanying drawings shows temperature characteristics of the toner image fixing apparatus shown in FIG. 14.

In FIG. 15, the horizontal axis represents the period of time in which the fixing belt B has rotated, and the vertical axis represents the temperature of the fixing belt B on the rollers R1, R3. First, a temperature characteristic of the toner image fixing apparatus at the time the amount of heat radiated by the heater H is controlled in order to equalize the temperature of the fixing belt B on the heating and tensioning roller R3 to a preset temperature T2 will be described below. A solid-line wavy curve W1 represents the temperature of the fixing belt B on the heating and tensioning roller R3, and a solid-line curve C1 represents the temperature of the fixing belt B on the fixing roller R1.

After a standby period, as the period of time in which the fixing belt B has rotated increases, the temperature of the fixing belt B on the fixing roller R1 increases. When the temperature of the fixing belt B on the fixing roller R1 exceeds an upper limit temperature T1 of a toner image fixing temperature range, the possibility of hot sheet offsets, i.e., sheet offsets at high temperatures, or sheet jams increases. When the temperature of the fixing belt B on the fixing roller R1 becomes lower than a lower limit temperature T1' of the toner image fixing temperature range, the possibility of cold sheet offsets, i.e., sheet offsets at low temperatures, or unfixed toner regions increases. Therefore, the temperature of the fixing belt B on the fixing roller R1 should be kept in the toner image fixing temperature range which lies between the upper limit temperature T1 and the lower limit temperature T1'.

The above drawback, i.e., sheet offsets and sheet jams, can be avoided when the temperature of the fixing belt B on the heating and tensioning roller R3 is set to a temperature T2', lower than the preset temperature T2, such that the temperature of the fixing belt B on the fixing roller R1 will be equal to or below the upper limit temperature T1 at its maximum, as indicated by broken-line characteristics curves W2, C2. However, it will take a longer period of time for the temperature of the fixing belt B on the fixing roller R1 to reach the lower limit temperature T1' of the toner image fixing temperature range, with the result that a fixation readiness time, i.e., a period of time required for the toner image fixing apparatus to become ready for fixing toner images, increases from TS to TS'.

After the toner image on the recording medium D is fixed, the sheet feeder for feeding the recording medium D into the toner image fixing apparatus is deactivated, the operation of the fixing belt B is stopped, and the heater H is de-energized, whereupon the toner image fixing apparatus enters a standby mode. Once the toner image fixing apparatus enters the standby mode, the surface temperatures of the fixing belt B and the fixing roller R1 fall gradually. If the standby mode continues for a long period of time, then the fixing belt B and the fixing roller R1 become so cold that when a fixing process is started again, it will take a long period of time before the fixing roller R1 is heated to the toner image fixing temperature range. As a result, the operator has to wait a long period of time before the toner image fixing apparatus is operational again.

To alleviate the above deficiency, there has been proposed a priority control process which employs an auxiliary thermistor (not shown) for measuring the temperature of the surface of the fixing roller R1. According to the proposed priority control process, as shown in FIG. 16 of the accompanying drawings, until the surface temperature of the fixing roller R1 rises nearly to the toner image fixing temperature range, the amount of heat radiated by the heater H is controlled on the basis of the surface temperature of the heating and tensioning roller R3 as measured by the thermistor S. When the surface temperature of the fixing roller R1 increases beyond the toner image fixing temperature range, the amount of heat radiated by the heater H is controlled on the basis of the surface temperature of the fixing roller R1 as measured by the auxiliary thermistor. The priority control process is effective to prevent sheet offsets and sheet jams from occurring, and also to shorten the period of time required to heat the fixing roller R1 to the toner image fixing temperature range after the standby mode.

Image forming systems such as electronic copying machines, electronic printers, etc. which incorporate the above toner image fixing apparatus are required in recent years to operate at a higher speed to meet demands for a higher sheet feed speed, i.e., an increased number of sheets fed per unit time through the toner image fixing apparatus. To meet such requirements, the fixing belt B needs to run at a higher speed, which results in a reduction in the amount of heat that is transferred per unit time from the heating and tensioning roller R3 to the fixing belt B.

As described above, the thermistor S is held in contact with the non-sheet-contact area of the fixing belt B on the heating and tensioning roller R3. When sheets, e.g., recording mediums D, are successively fed into the toner image fixing apparatus, since the non-sheet-contact area of the fixing belt B on the heating and tensioning roller R3 is not contacted by the sheets, the heat in the non-sheet-contact area of the fixing belt B is not dissipated, but stored therein, so that the temperature as measured by the thermistor S increases to a level beyond a heater control switching point shown in FIG. 16. When the heater control switching point is reached while successive sheets are being fed into the toner image fixing apparatus, the controlling of the amount of heat radiated by the heater H on the basis of the surface temperature of the fixing roller R1 as measured by the auxiliary thermistor switches to the controlling of the amount of heat radiated by the heater H on the basis of the surface temperature of the heating and tensioning roller R3 as measured by the thermistor S.

As a consequence, though the amount of heat radiated by the heater H is kept at a constant level based on the temperature measured by the thermistor S, the heat of the fixing roller R1 is greatly absorbed by the sheets that are being fed successively at a high speed. Therefore, as shown in FIG. 17 of the accompanying drawings, the surface temperature of the fixing roller R1 gradually falls. According to the priority control process, since the surface temperature of the fixing roller R1 gradually falls while sheets are being fed successively at a high speed, toner images may not be fixed to the sheets with good toner image fixability.

It has been proposed to incorporate another heater in the pressing roller R2 to meet the requirements for the toner image fixing apparatus to operate at a higher speed.

When small-size sheets or recording mediums D are successively fed into the toner image fixing apparatus, those sheets are not brought into contact with a non-sheet-contact area of the heating and tensioning roller R3 which is associated with the thermistor S. Therefore, the non-sheet-contact area of the heating and tensioning roller R3 stores a large amount of heat, and hence its temperature rises excessively, as shown in FIG. 15.

When the temperature non-sheet-contact area of the heating and tensioning roller R3 increases excessively, the surface temperature of the fixing roller R1 also increases excessively. The fixing roller R1 thus tends to deteriorate soon, have a shortened service life, cause an increased energy loss, and pose safety problems.

SUMMARY OF THE INVENTION

It is therefore an object of the present invention to provide a toner image fixing apparatus which is capable of fixing an unfixed toner image carried on a recording medium to the recording medium with good toner image fixability even when the recording medium is fed at an increased speed.

Another object of the present invention is to provide a toner image fixing apparatus which is capable of holding the surface temperature of a fixing roller substantially in a toner image fixing temperature range even when a recording medium with an unfixed toner image carried thereon is fed at an increased speed.

Still another object of the present invention is to provide an apparatus for and a method of fixing a toner image to a recording medium while preventing the surface temperature of a fixing roller from increasing excessively even when the recording medium is fed at an increased speed.

Yet another object of the present invention is to provide an apparatus for and a method of fixing a toner image to a recording medium while holding the surface temperature of a fixing roller substantially in a toner image fixing temperature range even when the recording medium is fed at an increased speed.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

FIG. 11 is a flowchart of a standby mode control process according to a first modification;

FIG. 12 is a flowchart of a sheet feed mode control process according to the first modification;

DETAILED DESCRIPTION OF THE PREFERRED EMBODIMENTS

General Structure of Toner Image Fixing Apparatus 10

Figure 1:
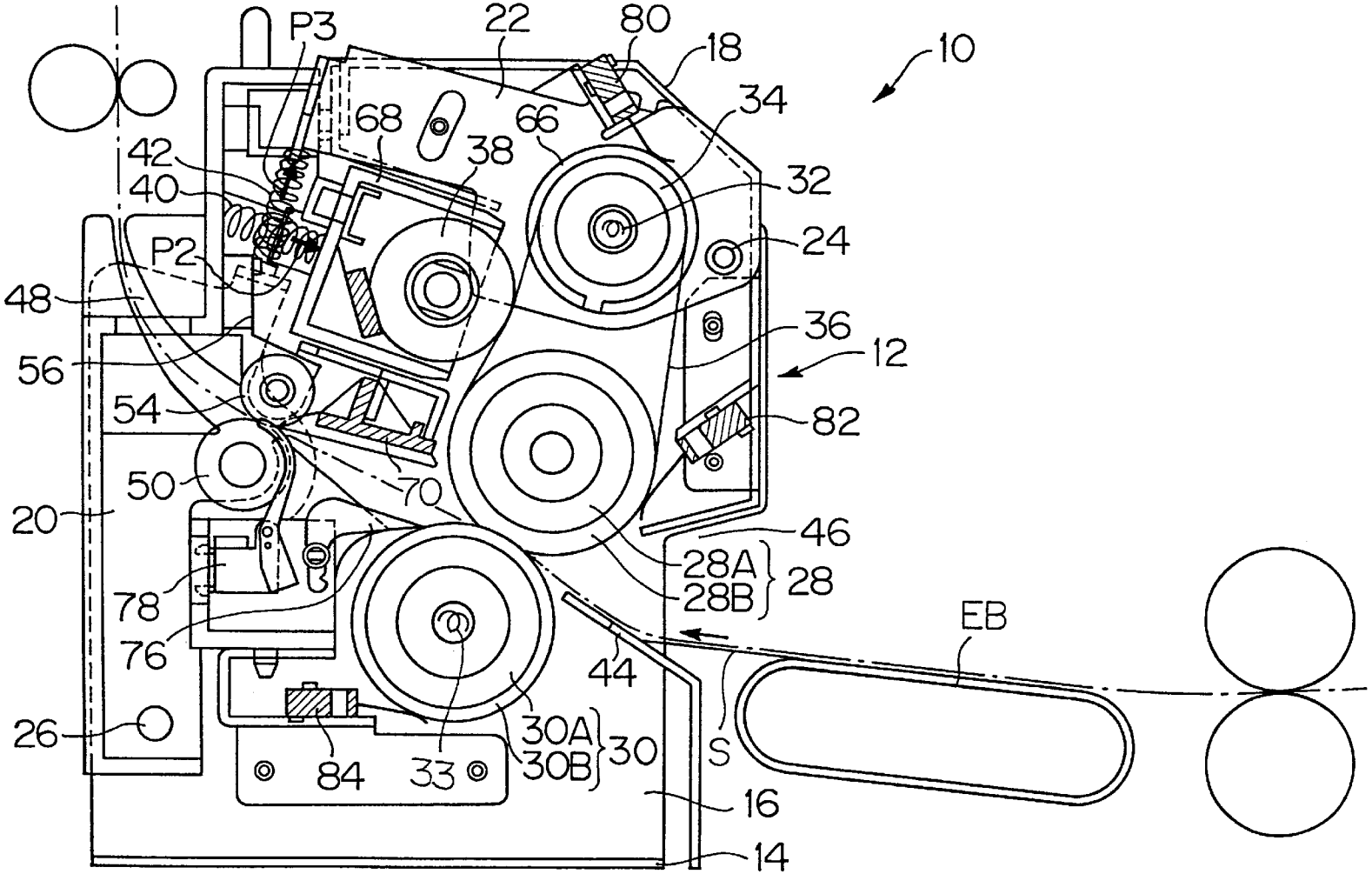
FIG. 1 is a sectional front elevational view of a toner image fixing apparatus according to an embodiment of the present invention.

As shown in FIG. 1, a toner image fixing apparatus 10 according to an embodiment of the present invention has a housing 12 to be fixed to a frame of an electronic image forming system (not shown) such as an electronic printer, for example. The housing 12 comprises a base plate 14 to be fixed directly to the frame, a pair of vertical side plates 16 erected from respective side edges of the base plate 14, an upper cover 18 mounted on the side plates 16 to cover upper right regions of the side plates 16, and a left cover 20 mounted on the side plates 16 to cover left side regions of the side plates 16.

The upper cover 18 is fixedly mounted on the side plates 16. A swing lever 22 is swingably supported on right portions of the side plates 16 by a first pivot shaft 24 positioned on a right end of the swing lever 22, for swinging movement about the first pivot shaft 24 to provide an open space at a left end of the swing lever 22. The left cover 20 is swingably supported on the side plates 16 by a second pivot shaft 26 positioned on a lower end of the left cover 20, for swinging movement about the second pivot shaft 24 to provide an open space at an upper end of the left cover 20.

The toner image fixing apparatus 10 has a roller assembly including a fixing roller 28 rotatably supported on the side plates 16 for rotation about a. fixed axis, a pressing roller 30 positioned obliquely downwardly of the fixing roller 28 in rolling contact with the fixing roller 28 and rotatably supported on the side plates 16 for rotation about a fixed axis parallel to the fixed axis of the fixing roller 28, and a heating roller 34 positioned obliquely upwardly of the fixing roller 28 and rotatably supported on the swing lever 22 for rotation about its own axis.

The toner image fixing apparatus 10 also has a first heat source 32 such as a halogen lamp or the like disposed in the heating roller 34, a second heat source 33 such as a halogen lamp or the like disposed in the pressing roller 30, and an endless fixing belt (heat transfer belt) 36 trained around the fixing roller 28 and the heating roller 34.

Figure 2:
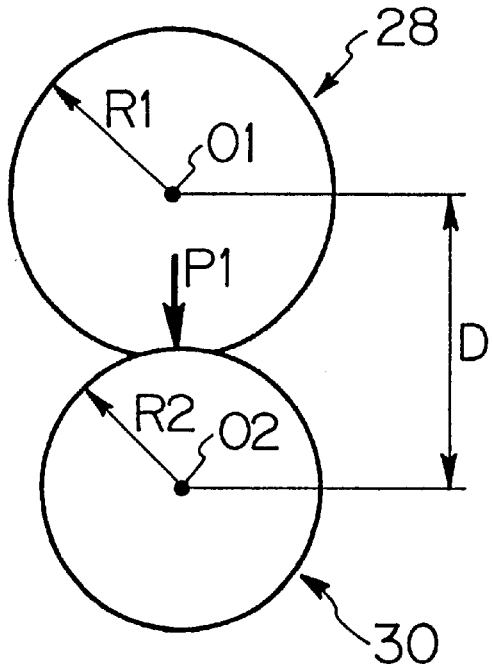
FIG. 2 is a schematic view showing the manner in which a fixing roller and a pressing roller are held in rolling contact with each other.

The fixing roller 28 comprises a resilient roller, and the pressing roller 30 comprises a roller harder than the fixing roller 28. As shown in FIG. 2, the fixing roller 28 and the pressing roller 30 have respective centers O1, O2 spaced from each other by a distance D which is slightly smaller than the sum (R1+R2) of their radii R1, R2. In a rolling contact region (nipping region) between the fixing roller 28 and the pressing roller 30, the fixing roller 28 and the pressing roller 30 are held in rolling contact with each other under a predetermined pressure P1, so that the fixing roller 28 has an outer circumferential surface made partly concave by the pressing roller 30 held in rolling contact therewith, thus providing a sufficient nipping width in a direction across the axes of the fixing roller 28 and the pressing roller 30.

The toner image fixing apparatus 10 also has an oil applying roller 38 for applying silicone oil to an outer circumferential surface of the fixing belt 36 and cleaning the outer surface of the fixing belt 36, a first helical spring 40 for normally pressing the oil applying roller 38 against the fixing belt 36 perpendicularly thereto to tension the fixing belt 36, and a second helical spring 42 for normally urging the heating roller 34 in a direction away from the fixing roller 28 to tension the fixing belt 36 in coaction with the first helical spring 40.

The upper cover 18 has a right lower portion bent inwardly into the housing 12. A guide plate 44 is positioned below and largely spaced from the bent right lower portion of the upper cover 18. The guide plate 44 and the bent right lower portion of the upper cover 18 jointly define an inlet port 46 therebetween for introducing therethrough a sheet S with an unfixed toner image carried thereon (hereinafter referred to as an "unfixed toner sheet") into the housing 12 in the direction (feed direction) indicated by the arrow in FIG. 1

The guide plate 44 is inclined obliquely upwardly to the left such that the height of the guide plate 44 progressively increases into the housing 12. The guide plate 44 has an inlet end, i.e., a right end, positioned in confronting relation to an outlet end of a sheet feeding endless belt EB that is positioned in the electronic printer adjacent to the right end of the inlet port 46. The guide plate 44 has an outlet end, i.e., a left end, positioned in confronting relation to the rolling contact region (nipping region) between the fixing roller 28 and the pressing roller 30.

When the unfixed toner sheet S is fed in the feed direction indicated by the arrow toward the toner image fixing apparatus 10 by the endless belt EB, the leading end of the unfixed toner sheet S contacts the guide plate 44, and is then guided thereby to travel obliquely upwardly into the rolling contact region between the fixing roller 28 and the pressing roller 30.

A sheet discharge passage 48 is defined above the left cover 20 for discharging a sheet with a toner image fixed thereto with heat and pressure by the fixing roller 28 and the pressing roller 30 in the rolling contact region. Such a sheet will hereinafter be referred to as a "fixed toner sheet"). The sheet discharge passage 48 is oriented such that it discharges the fixed toner sheet substantially upwardly along a vertical plane.

A lower discharge roller 50 is rotatably mounted on the left cover 20 between the sheet discharge passage 48 and the rolling contact region. The lower discharge roller 50 is actuated by an actuating mechanism 52 (described later on) to rotate at a speed greater than the pressing roller 30, i.e., at a speed which is 5% greater than the speed at which the pressing roller 30 rotates. An upper discharge roller 54 is positioned obliquely upwardly of the lower discharge roller 50 and held in rolling contact with the lower discharge roller 50 under resilient forces from a leaf spring 56. The upper discharge roller 54 is positioned with respect to the lower discharge roller 50 such that a line interconnecting the centers of the upper and lower discharge rollers 54, 50 extends substantially perpendicularly across a sheet discharge passage along which the fixed toner sheet is delivered from the rolling contact region to the sheet discharge passage 48.

In the toner image fixing apparatus 10 thus constructed, the unfixed toner sheet S fed onto the guide plate 44 by the endless belt EB has its lower surface, opposite to the unfixed toner image, borne by the guide plate 44, and is guided by the guide plate 44 toward the rolling contact region (nipping region) between the fixing roller 28 and the pressing roller 30, with the fixing belt 36 being trained around the fixing roller 28. When the unfixed toner sheet S passes under pressure between the fixing roller 28 and the pressing roller 30, the unfixed toner image is fixed to the sheet S with heat and pressure.

Fixing Roller 28:

The fixing roller 28 comprises a core 28A rotatably supported on the side plates 16 by bearings (not shown) and a roller sleeve 28B fitted coaxially over the core 28A. The fixing belt 36 is trained around the roller sleeve 28B. The fixing roller 28 has an outside diameter of 38.0 mm in this embodiment. The core 28A comprises a shaft of iron having a diameter of 25 mm, and the roller sleeve 28B is made of a heat-resistant resilient material of silicone rubber having a wall thickness of 6.5 mm. Specifically, the roller sleeve 28B is made of a heat-resistant resilient material of silicon rubber having a JIS Model A hardness of 15.

Figure 4:
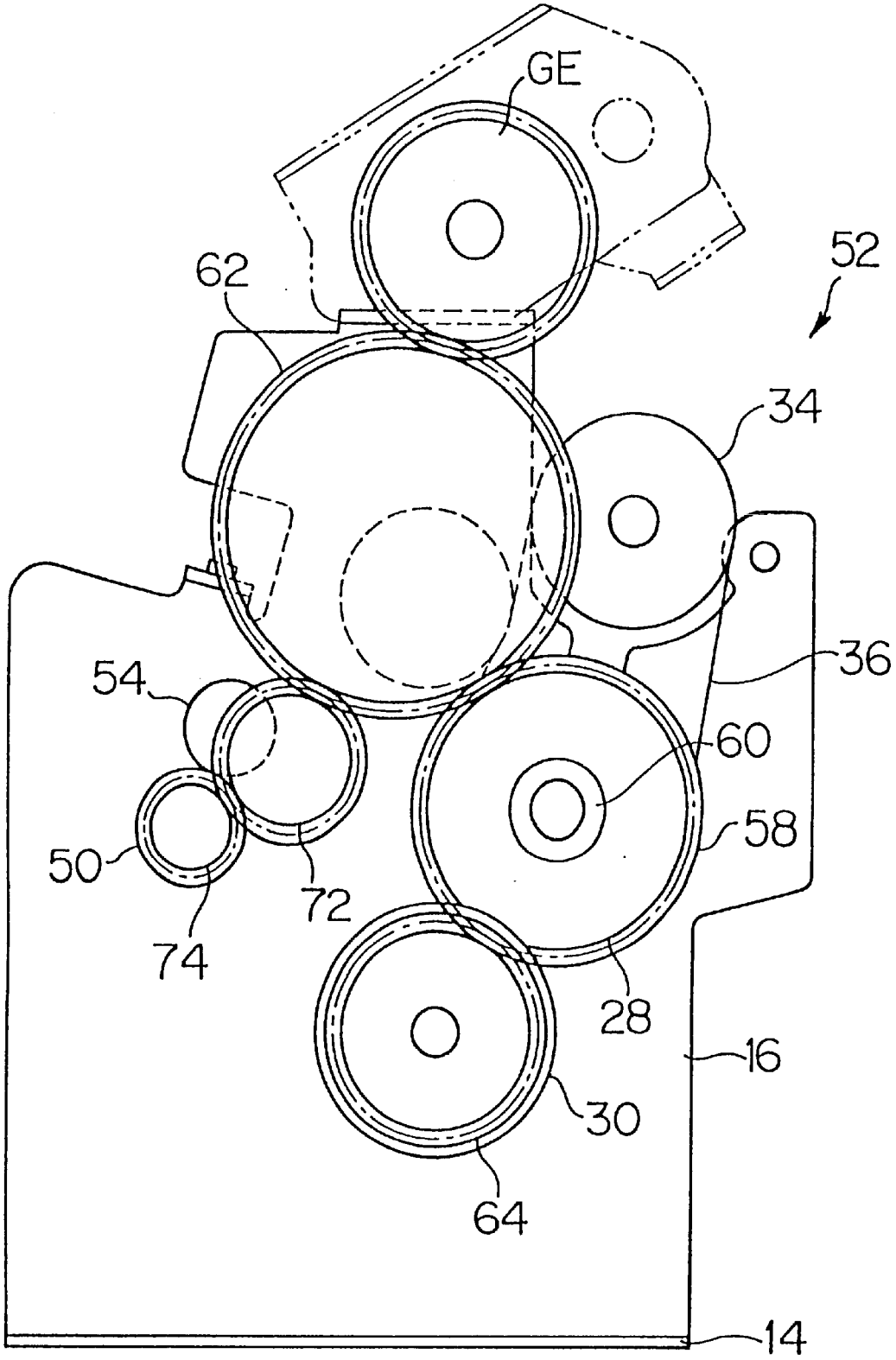
FIG. 4 is a schematic front elevational view of an actuating mechanism of the toner image fixing apparatus shown in FIG. 1.

As shown in FIG. 4, the core 28A has an end combined with a shaft which is coaxially coupled to a first driven gear 58 through a one-way clutch 60 (described later on). The first driven gear 58 is held in mesh with a transmission gear 62 of the actuating mechanism 52. Drive forces produced by the actuating mechanism 52 are transmitted through the transmission gear 62 to the first driven gear 58 which is rotated clockwise to rotate the fixing roller 28 through the one-way clutch 60.

Pressing roller 30:

As shown in FIG. 1, the pressing roller 30 comprises a core 30A rotatably supported on the side plates 16 by bearings (not shown) and a roller sleeve 30B fitted coaxially over the core 30A. The pressing roller 30 has an outside diameter of 35 mm in this embodiment. The core 30A comprises a shaft of iron having a diameter of 32 mm, and the roller sleeve 30B is made of a heat-resistant resilient material of silicone rubber having a wall thickness of 1.5 mm. Specifically, the roller sleeve 30B is made of silicone rubber having a JIS Model A hardness of 20, which is harder than the roller sleeve 28B. The outer circumferential surface of the roller sleeve 30B is covered with a tube of fluoroplastics having a wall thickness of 50 $\mu$m.

Figure 3:
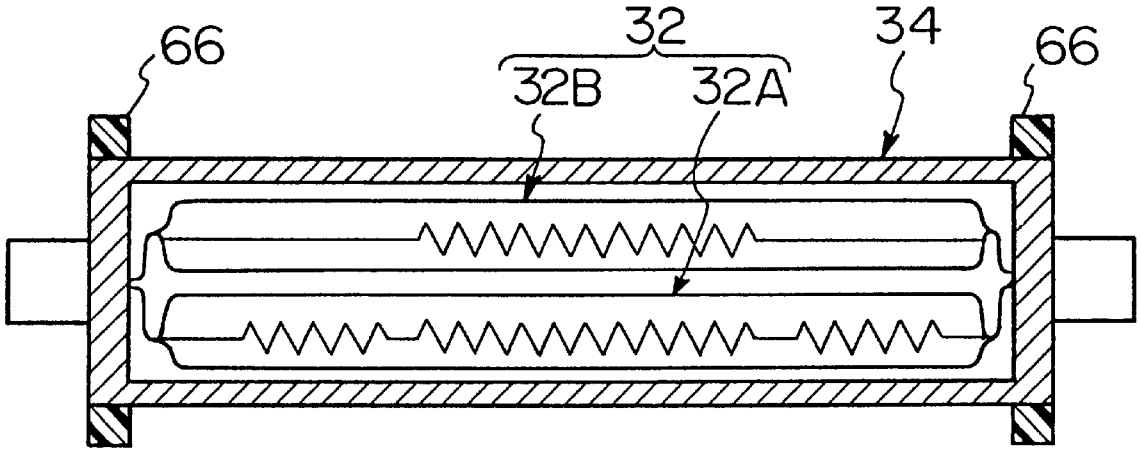
FIG. 3 is a cross-sectional view of a heating roller with a first heat source disposed therein.

As shown in FIG. 3, the core 30A has an end combined with a shaft which is coaxially coupled to a second driven gear 64 which is held in mesh with the first driven gear 58. Drive forces are transmitted from the first driven gear 58 to the second driven gear 64, which rotates the pressing roller 30 counterclockwise.

In this embodiment, the pressing roller 30 is used as a primary drive roller for feeding the unfixed toner sheet through the nipping region. The ratio of gear teeth of the first and second drive gears 58, 64 is selected such that the peripheral speed of the fixing roller 28 as it is thermally expanded is not greater than the peripheral speed of the pressing roller 30. Specifically, the speed at which the fixing roller 28 is rotated by the first driven gear 58 is slightly lower than the speed at which it is rotated in frictional engagement with the pressing roller 30 through the fixing belt 36.

The pressing roller 30 is not positioned directly downwardly of the fixing roller 28, but is displaced downstream in the feed direction of a position directly downward of the fixing roller 28. Specifically, the pressing roller 30 is positioned with respect to the fixing roller 28 such that an acute angle is formed between a vertical line passing through the center of the fixing roller 28 and a line segment passing through the centers of the fixing roller 28 and the pressing roller 30. The line segment passing through the centers of the fixing roller 28 and the pressing roller 30 extends perpendicularly to the feed direction across the rolling contact region.

One-Way Clutch 60:

The one-way clutch 60 allows the fixing roller 28 to rotate clockwise relatively to the first driven gear 58, but prevents the fixing roller 28 from rotating counterclockwise relatively to the first driven gear 58, i.e., rotates the fixing roller 28 and the first driven gear 58 in unison with each other. Specifically, when the fixing roller 28 is cold, i.e., when the fixing roller 28 and the fixing belt 36 are driven by the pressing roller 30 while the fixing belt 36 is held in frictional engagement with the pressing roller 30 and the fixing roller 28 is held in frictional engagement with the fixing belt 36, the peripheral speed of the fixing roller 28 upon clockwise rotation thereof is the same as the peripheral speed of the pressing roller 30, and hence is slightly higher than the peripheral speed of the first driven gear 58. The difference between the peripheral speeds of the fixing roller 28 and the first driven gear 58 is absorbed by the one-way clutch 60.

When the heating roller 34 is heated by the heater 32 and the fixing roller 28 is heated through the fixing belt 36, the outside diameter of the fixing roller 28 is increased as it is thermally expanded, and the peripheral speed of the fixing roller 28 increases. Since the peripheral speed of the fixing roller 28 does not become higher than the peripheral speed of the pressing roller 30, the increase in the peripheral speed of the fixing roller 28 is absorbed by the one-way clutch 60.

The one-way clutch 60 offers the following advantages: If the one-way clutch 60 were not employed, when a sheet with a glossy and slippery surface, such as a coated sheet, is fed as an unfixed toner sheet into the rolling contact region, the fixing belt 36 would slip against the unfixed toner sheet, and drive forces would not be transmitted from the pressing roller 30 to the fixing belt 36 and the fixing roller 28, which would not then be driven by the pressing roller 30. Therefore, the unfixed toner sheet would be jammed in the rolling contact region, or even if the unfixed toner sheet passed through the rolling contact region, the unfixed toner image on the unfixed toner sheet would be abraded and disturbed by the fixing belt 36 kept at rest.

In this embodiment, however, since the one-way clutch 60 is connected between the fixing roller 28 and the first driven gear 58, even if drive forces from the pressing roller 30 are not transmitted tQ the fixing belt 36, the fixing roller 28 is rotated clockwise by the first driven gear 58 through the one-way clutch 60 when the peripheral speed of the fixing roller 28 starts being lower than the peripheral speed of the first driven gear 58. Therefore, the unfixed toner sheet passes reliably through the rolling contact region for effective protection against a sheet jam in the nipping region and toner image disturbance on the sheet.

Heating Roller 34:

In this embodiment, the heating roller 34 comprises a core in the form of an aluminum pipe having a diameter of 30 mm and a wall thickness of 3.5 mm. The core is coated with a polytetrafluoroethylene (PTFE) layer having a thickness of 20 $\mu$m. A circular collar 66 made of heat-resistant polyetheretherketone (PEEK) and having a diameter of 34 mm is press-fitted over each of opposite bearing ends of the core for preventing the fixing belt 36 from being tortured or displaced out of position.

As shown in FIG. 3, the first heat source 32 disposed in the heating roller 34 comprises an axially longer first halogen lamp 32A for heating larger-size sheets and an axially shorter second halogen lamp 32B for heating smaller-size sheets, the first and second halogen lamps 32A, 32B extending axially parallel to each other. The larger-size sheets may be A4-size sheets fed in landscape orientation, A3-size sheets fed in portrait orientation, B5-size sheets fed in landscape orientation, B4-size sheets fed in fed in portrait orientation, etc., and the smaller-size sheets may be B5-size sheets fed in portrait orientation, A4-size sheets fed in portrait orientation, postcard-size sheets fed in either landscape or portrait orientation, etc.

In this embodiment, the longer first halogen lamp 32A is of such a length as to be able to cover the distance of 297 mm which represents the dimension of a shorter side of A3-size sheets, and the shorter second halogen lamp 32B is of such a length as to be able to cover the distance of 210 mm which represents the dimension of a shorter side of A4-size sheets. Each of the first and second halogen lamps 32A, 32B has such a luminous intensity distribution that the luminous intensity is 30–50% greater at its opposite ends than at its center.

Fixing Belt 36:

The fixing belt 36 preferably has a heat capacity of 0.002 cal/°C.–0.025 cal/°C. per $cm^2$ so as to be able to preheat the unfixed toner on the unfixed toner sheet S to a fixing temperature through heat radiation for thereby fixing the toner without applying excessive heat. In this embodiment, the fixing belt 36 comprises an endless belt base of polyimide having an inside diameter of 60 mm and a thickness of 100 $\mu$m and a heat-resistant resilient separating layer of silicone rubber that is coated to a thickness of 200 $\mu$m on an outer circumferential surface of the endless belt base of polyimide.

Alternatively, the fixing belt 36 may comprise an endless belt base of electroformed nickel having a thickness of 40 $\mu$m and a heat-resistant resilient separating layer of silicone rubber that is coated to a thickness of 200 $\mu$m on an outer circumferential surface of the endless belt base of electroformed nickel.

Oil Applying Roller 38:

The oil applying roller 38 serves to apply a small amount of silicone oil to the outer circumferential surface of the fixing belt 36 for separating the sheet S easily from the fixing belt 36. The oil applying roller 38 comprises a support shaft 38A rotatably supported in a casing 68 for rotation about a fixed axis and a heat-resistant layer 38B of paper fitted over the support shaft 38A and impregnated with silicone coil. In this embodiment, the support shaft 38A comprises a shaft of iron having a diameter of 8 mm, and the heat-resistant layer 38B of paper is covered with a film 38C of porous fluoroplastics having a thickness of 100 $\mu$m. The oil applying roller 38 has a diameter of 22 mm. The oil applying roller 38 thus constructed is capable of stably applying a small amount of silicone oil to the outer circumferential surface of the fixing belt 36.

The outer circumferential surface of the oil applying roller 38 is smeared with dirt such as of toner particles that is transferred from the outer circumferential surface of the fixing belt 36. A cleaning brush 39 is held in sliding contact with the outer circumferential surface of the oil applying roller 38 for removing such dirt off the outer circumferential surface of the oil applying roller 38 thereby to clean the oil applying roller 38.

Tensioning Mechanism for the Fixing Belt 36:

As described above, a mechanism for tensioning the fixing belt 36 has the first helical spring 40 for normally pressing the oil applying roller 38 against the fixing belt 36 perpendicularly thereto to tension the fixing belt 36, and the second helical spring 42 for normally urging the heating roller 34 in a direction away from the fixing roller 28 to tension the fixing belt 36 in coaction with the first helical spring 40.

The first helical spring 40 is attached to the left cover 20 for normally urging the casing 68, on which the oil applying roller 38 is rotatably supported, toward the fixing belt 36. The casing 68 is movably supported by a guide rib 70 on one of the side plates 16 for movement toward and away from the fixing belt 36. When the left cover 20 is swung open to the left about the second pivot shaft 26, the first helical spring 40 is disengaged from the casing 68, releasing the oil applying roller 38 from the fixing belt 36. When the left cover 20 is swung to the right about the second pivot shaft 26, the first helical spring 40 pushes the casing 68 under a pressing force P2, causing the oil applying roller 38 to press the fixing belt 36 under a certain tension.

The second helical spring 42 is connected between the left end of the swing lever 22 and the side plate 16 for normally urging the swing lever 22 to turn clockwise about the first pivot shaft 24, i.e., to push the heating roller 34 on the swing lever 22 under a pressing force P3 in a direction away from the fixing roller 28. In this manner, the fixing belt 36 is given a desired tension.

Therefore, the heating roller 34 is displaced away from the fixing roller 28 by the swing lever 22 under the bias of the second helical spring 42, tensioning the fixing belt 36 trained around the heating roller 34 and the fixing roller 28.

The fixing belt 36 thus tensioned by the first and second helical springs 40, 42 is held in frictional engagement with the pressing roller 30 and driven thereby. When the fixing belt 36 is driven by the pressing roller 30. The fixing roller 28 is stably driven thereby without slipping or sagging with respect to the fixing belt 36.

Actuating Mechanism 52:

As shown in FIG. 4, the transmission gear 62 is held in mesh with an output gear GE that is connected through a gear train (not shown) to an actuator in the electronic printer when the toner image fixing apparatus 10 is installed in the electronic printer. The transmission gear 62 can be driven to rotate by the output gear GE. The actuating mechanism 52 also has, in addition to the transmission gear 62, the first driven gear 58 held in mesh with the transmission gear 62 and coupled to the fixing roller 28 through the one-way clutch 60, and the second driven gear 64 held in mesh with the first driven gear 58 and fixed coaxially to the pressing roller 30.

The actuating mechanism 52 also has an idler gear 72 held in mesh with the transmission gear 62. The idler gear 72 is also held in mesh with a third driven gear 74 fixed coaxially to the lower discharge roller 50 for rotating the lower discharge roller 50 at a speed equal to or higher than the rotational speed of the pressing roller 30.

Other Structural Details:

As shown in FIG. 1, the toner image fixing apparatus 10 has a peeler blade 76 for peeling the fixed toner sheet off the outer circumferential surface of the pressing roller 30, and a sheet sensor 78 for detecting the leading end of the fixed toner sheet as it is fed to a rolling contact region between the upper and lower discharge rollers 54, 50.

Control System:

The toner image fixing apparatus 10 further comprises a control system (see FIG. 5) which includes a controller 86 for controlling the actuating mechanism 52, the first heat source 32 disposed in the heating roller 34, and the second head source 33 disposed in the pressing roller 30. To the controller 86, there are electrically connected a first thermistor 80 for detecting the temperature (heating roller temperature) Th of a non-sheet-contact area (which is not contacted by the unfixed toner sheet S) of the fixing belt 36 on the heating roller 34, a second thermistor 82 for detecting the temperature (fixing roller temperature) Tf of a sheet-contact area (which is contacted by the unfixed toner sheet S) of the fixing belt 36 on the fixing roller 28, and a third thermistor 84 for detecting the temperature (pressing roller temperature) Tp of the outer circumferential surface of the pressing roller 30. Based on the temperatures Th, Tf, Tp detected by the first, second, and third thermistors 80, 82, 84, the controller 86 controls the heat generated by the first and second heat sources 32, 33.

The controller 86 also controls the first halogen lamp 32A of the first heat source 32 through a first heater driver 88A, the second halogen lamp 32B of the first heat source 32 through a second heater driver 88B, and a halogen lamp of the second head source 33 through a third heater driver 88C according to a control sequence described later on.

Position of the Heating Roller 34:

The heating roller 34 is positioned substantially upwardly of the fixing roller 28. Therefore, the fixing belt 36 that is trained around the fixing roller 28 and the heating roller 34 is so spaced from the guide plate 44 that the unfixed toner sheet fed on the guide plate 44 will not be brought into contact with the fixing belt 36. Stated otherwise, the fixing belt 36 is disposed in a position outside of a region where the unfixed toner sheet fed on the guide plate 44 possibly passes.

Because the heating roller 34 is positioned substantially upwardly of the fixing roller 28, the unfixed toner sheet S carried on the upper surface of the guide plate 44 is reliably prevented from contacting the fixing belt 36 irrespective of how the unfixed toner sheet being fed may be curled. Consequently, the unfixed toner sheet S can be led to the rolling contact region between the fixing roller 28 and the pressing roller 30 without disturbing the unfixed toner image on the unfixed toner sheet S, so that the unfixed toner image on the unfixed toner sheet S can reliably be fixed to the unfixed toner sheet S in the rolling contact region.

Figure 5:
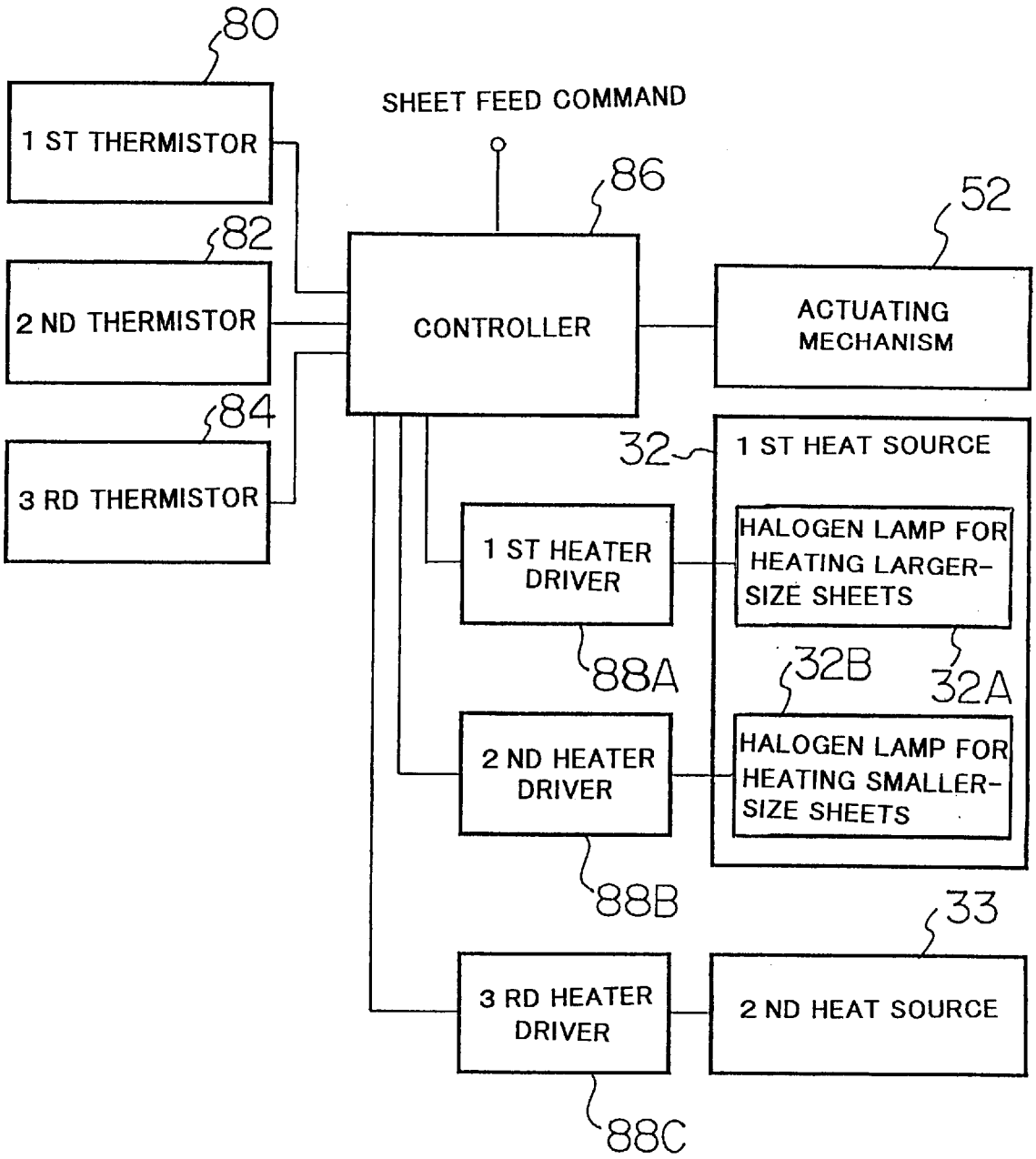
FIG. 5 is a block diagram of a control system for controlling heat sources in the toner image fixing apparatus shown in FIG. 1.
Figure 6:
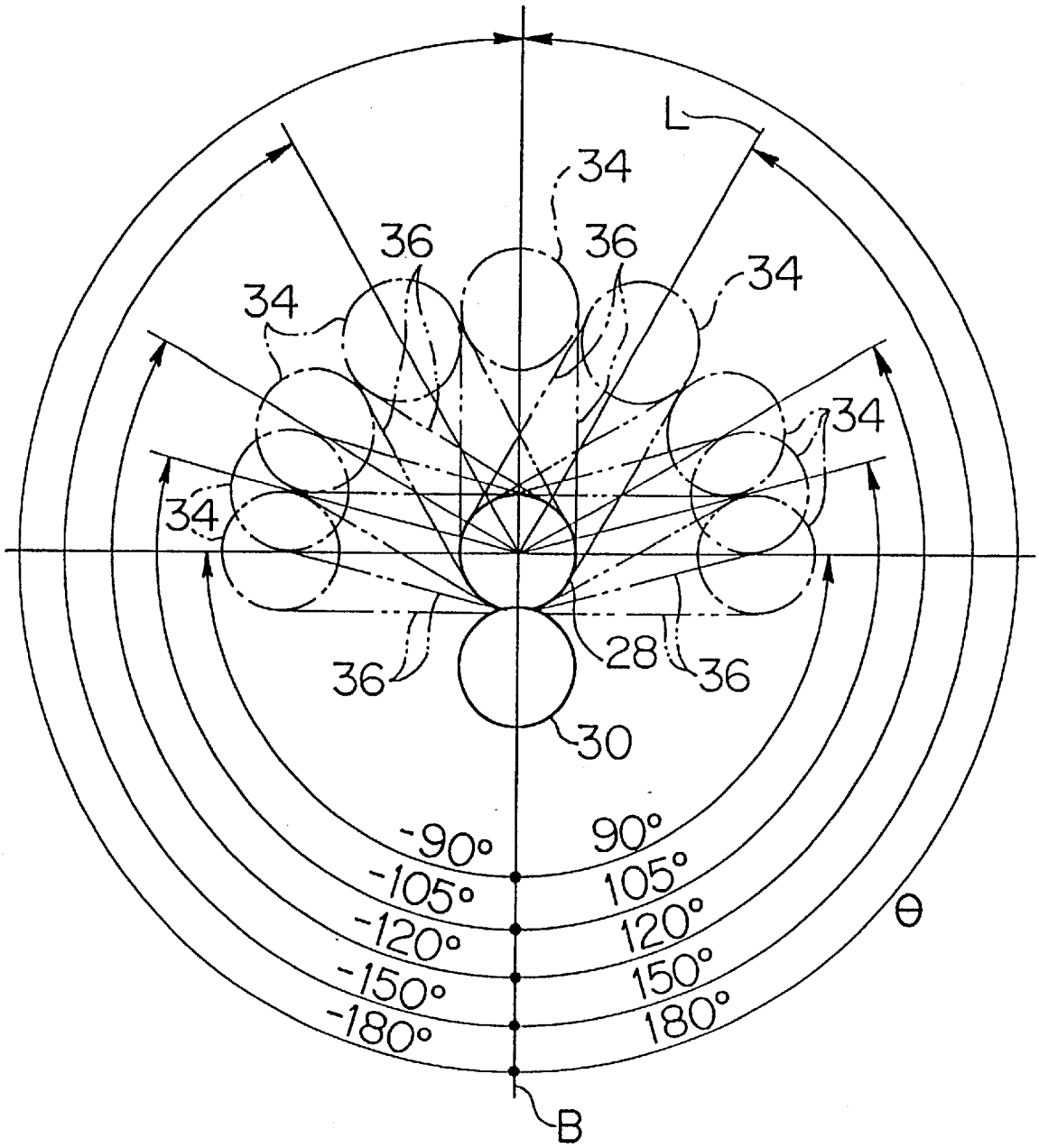
FIG. 6 is a diagram showing angles employed in an experiment conducted to check an allowable range of positions of the heating roller with respect to the fixing roller.

Angle of the Heating Roller 34:

The fact that the heating roller 34 is positioned substantially upwardly of the fixing roller 28 offers advantages inherent in the toner image fixing apparatus 10. An experiment to determine an optimum angular range in which the heating roller 34 can be positioned substantially upwardly of the fixing roller 28 by changing the angle of the heating roller 34 as shown in FIG. 5 will be described below.

In the experiment, a straight line passing through the centers of the fixing roller 28 and the pressing roller 30 was defined as a reference line B, and an angle θ was defined between the reference line B and a line segment L interconnecting the centers of the fixing roller 28 and the heating roller 34. The angular position of the heating roller 34 with respect to the fixing roller 28 was changed to change the angle θ between 90° and 180°, and the frequency of rubbed states of toner images at the inlet of the rolling contact region between the fixing roller 28 and the pressing roller 30 and also the frequency of defects of toner images at the outlet of the rolling contact region between the fixing roller 28 and the pressing roller 30 were measured when the toner images were copied on one side and both sides of sheets.

The angle θ was defined as a positive angle when measured counterclockwise from the reference line B, and as a negative angle when measured clockwise from the reference line B. Therefore, the heating roller 34 positioned at the angle θ=+180° and the heating roller 34 positioned at the angle θ=−180° were in the same angular position, and the heating roller 34 positioned at the angle θ=+105° and the heating roller 34 positioned at the angle θ=−255° were in the same angular position. Defects of toner images at the outlet of the rolling contact region represent sheet offsets or sheet jams.

The experiment was conducted under the following conditions:

The nipping width in the rolling contact region was set to 8 mm, and the pressing roller 30 applied a pressure P1 of 24 kgf to one side of the unfixed toner sheet S. The temperature of the fixing belt 36 trained around the fixing roller 28 was set to 160° C. The surface temperature of the pressing roller 30 was set to 140° C. The speed at which to feed the unfixed toner sheet S was set to 180 mm/sec. The pressing roller 30 was rotated in synchronism with the speed of 180 mm/sec. The toner used was an A color toner manufactured by Fuji Xerox. The sheet S used was plain paper having a weight of 64 g/m$^2$.

The experiment was made for nine angles θ of 90°, 105°, 120°, 150°, 180°, −150°, −120°, −105°, −90°.

The results of the experiment are given in Table 1 shown below.

TABLE 1

| Angles | Copied on one side A | Copied on one side B | Copied on both sides A | Copied on both sides B | Evaluation |
|---|---|---|---|---|---|
| 90° | 3/5 | 0/5 | 5/5 | 0/5 | Not acceptable |
| 105° | 0/5 | 0/5 | 1/5 | 0/5 | Partly acceptable |
| 120° | 0/5 | 0/5 | 0/5 | 0/5 | Acceptable |
| 150° | 0/5 | 0/5 | 0/5 | 0/5 | Acceptable |
| ±180° | 0/5 | 0/5 | 0/5 | 0/5 | Acceptable |
| −150° | 0/5 | 0/5 | 0/5 | 0/5 | Acceptable |
| −120° | 0/5 | 0/5 | 0/5 | 0/5 | Acceptable |
| −105° | 0/5 | 2/5 | 0/5 | 3/5 | Not acceptable |
| −90° | 0/5 | 5/5 | 0/5 | 5/5 | Not acceptable |

A: The frequency of rubbed states of toner images at the inlet of the rolling contact region.
B: The frequency of defects of toner images at the outlet of the rolling contact region.

As can be seen from Table 1, when the angle θ is greater than 105° and smaller than −105°, i.e., when the angle θ is in a range from 105° to 255° as measured only counterclockwise, toner images were neither rubbed at the inlet of the rolling contact region and nor defective at the outlet of the rolling contact region, indicating a good toner image fixing process. However, when the angle θ is equal to or smaller than 105°, toner images were either rubbed at the inlet of the rolling contact region and or defective at the outlet of the rolling contact region, indicating a poor toner image fixing process.

Heating Control by the Controller 86:

A control process or sequence carried out by the controller 86 for controlling the heating of the first and second heat sources 32, 33 will be described below with reference to the flowcharts of FIGS. 7 through 9.

The controller 86 comprises a CPU (Central Processing Unit) for controlling the control system shown in FIG. 5, a ROM (Read-Only Memory) for storing programs, a RAM (Random-Access Memory) for storing thresholds, settings, and other data, an interface for transmitting data between the controller 86 and a controller of the electronic printer which incorporates the toner image fixing apparatus 10, and various I/O (Input/Output) ports. Unless a sheet feed command is supplied from the electronic printer, the controller 86 keeps the toner image fixing apparatus 10 in a standby mode, and executes a predetermined standby mode control sequence. When a sheet feed command is supplied from the electronic printer, the controller 86 operates the toner image fixing apparatus 10 in a sheet feed mode, and executes a predetermined sheet feed mode control sequence.

Specifically, in the standby mode, the controller 86 controls the first heat source 32 to heat the heating roller 34 to a first temperature setting T1 based on the heating roller temperature Th detected by the first thermistor 80, and also controls the second heat source 33 to heat the pressing roller 30 to a second temperature setting T2 based on the pressing roller temperature Tp detected by the third thermistor 84. In the sheet feed mode, the controller 86 controls the first heat source 32 to heat the fixing roller 28 to a third temperature setting T3 based on the fixing roller temperature Tf detected by the second thermistor 82.

The controller 86 controls the amount of heat generated by the first halogen lamp 32A of the first heat source 32 with the first heater driver 88A, controls the amount of heat generated by the second halogen lamp 32B of the first heat source 32 with the second heater driver 88B, and controls the amount of heat generated by the halogen lamp of the second head source 33 with the third heater driver 88C.

In the sheet feed mode, the controller 86 determines the size of a sheet being fed based on sheet information. If the controller 86 determines the size of a sheet being fed as a large size, then the controller 86 energizes only the first halogen lamp 32A of the first heat source 32 with the first heater driver 88A, and also energizes the halogen lamp of the second heat source 33 with the third heater driver 88C in the same manner as with the standby mode. If the controller 86 determines the size of a sheet being fed as a small size, then the controller 86 energizes only the second halogen lamp 32B of the first heat source 32 with the second heater driver 88B.

The above control process or sequence carried out by the controller 86 will be described in more detail below with reference to FIGS. 7 through 9.

Figure 7:
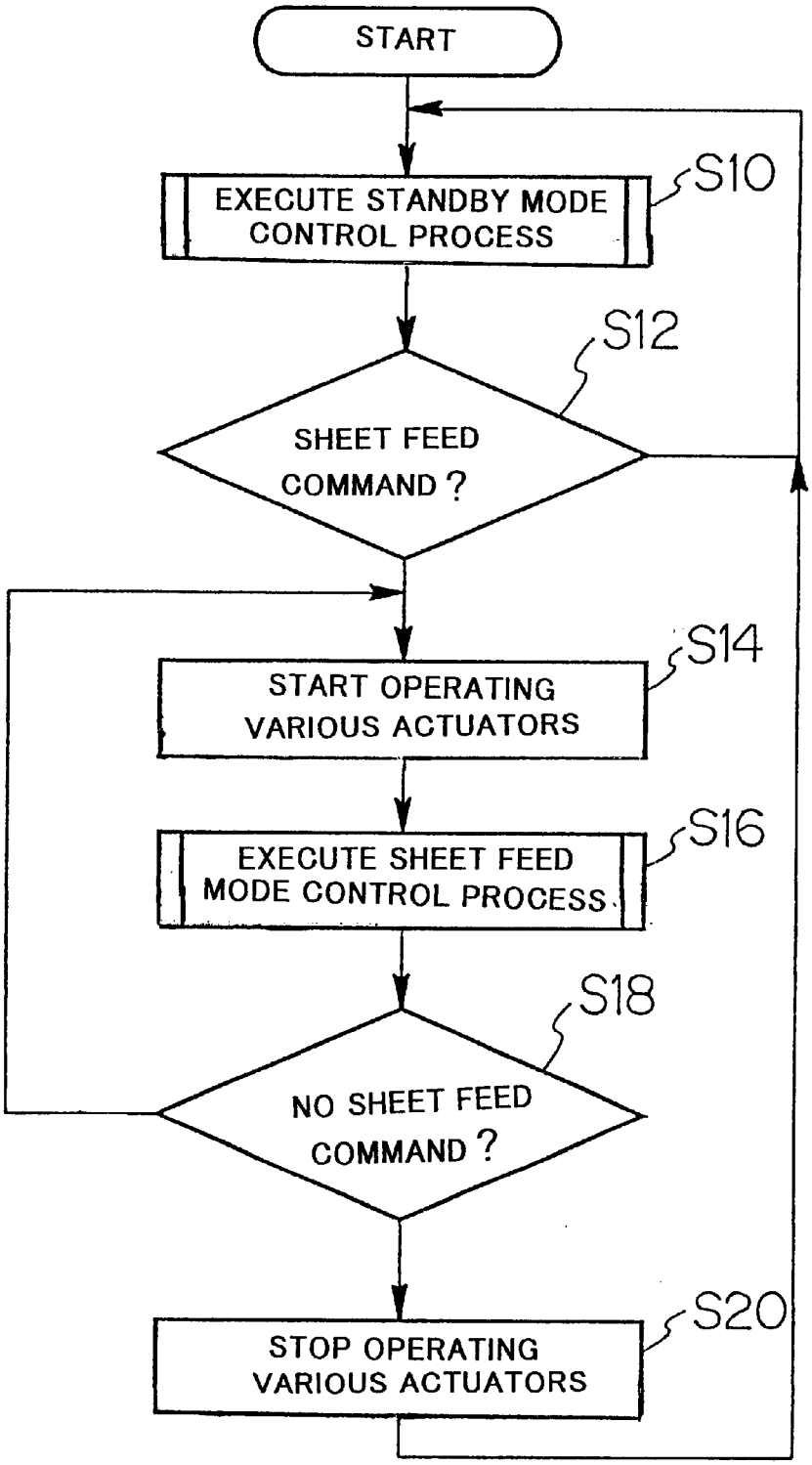
FIG. 7 is a flowchart of the main routine of a control sequence carried out by a controller of the control system for controlling the heat sources.

Main Routine of the Control Sequence of the Controller 86:

As shown in FIG. 7, when the toner image fixing apparatus 10 is turned on, the controller 86 carries out a predetermined initializing process, and then executes a standby mode control process for controlling the heating of the first and second heat sources 32, 33 in step S10. The subroutine of the standby mode control process in step S10 will be described in more detail later on with reference to FIG. 8.

The controller 86 executes the standby mode control process in step S10 until a sheet feed command is supplied from the electronic printer in step S12. When a sheet feed command is supplied from the electronic printer, the controller 86 starts to operate various actuators of the actuating mechanism 52 and controls the actuators according to a predetermined actuator control process in step S14. The controller 86 also carries out a sheet feed mode control process for controlling the heating of the first and second heat sources 32, 33 in step S16. The actuator control process in step S14 will not be described below as it has no direct bearing on the present invention. The subroutine of the sheet feed mode control process in step S16 will be described in more detail later on with reference to FIG. 9.

The controller 86 executes the sheet feed mode control process in step S16 insofar as there is a sheet feed command supplied from the electronic printer. When there is no longer a sheet feed command from the electronic printer in step S18, the controller 86 stop operating the various actuators of the actuating mechanism 52 in step S20. Then, control returns to step S10 to execute the standby mode control process.

In this manner, the controller 86 basically controls the heating of the first and second heat sources 32, 33.

Subroutine of the Standby Mode Control Process:

The subroutine of the standby mode control process in step S10 shown in FIG. 7 will be described below with reference to FIG. 8.

When the standby mode control process begins, the controller 86 detects the heating roller temperature Th with the first thermistor 80 in step S10A, and decides whether the detected heating roller temperature Th is higher than the first temperature setting T1 or not in step S10B. If the detected heating roller temperature Th is not higher than the first temperature setting T1, then since the heating roller temperature Th has not yet reached the first temperature setting T1 as a target temperature, the controller 86 energizes only the first halogen lamp 32A of the first heat source 32 in the heating roller 34 to generate heat therefrom in step S10C.

Conversely, if the detected heating roller temperature Th is higher than the first temperature setting T1 in step S10B, then since the heating roller temperature Th has already exceeded the first temperature setting T1, the controller 86 de-energizes the first halogen lamp 32A of the first heat source 32 in the heating roller 34 to stop generating heat therefrom in step S10D.

After having thus controlled the heating of the first heat source 32 in the heating roller 34 based on the heating roller temperature Th, the controller 86 detects the pressing roller temperature Tp with the third thermistor 84 in step S10E, and decides whether the detected pressing roller temperature Tp is higher than the second temperature setting T2 or not in step S10F. If the detected pressing roller temperature Tp is not higher than the second temperature setting T2, then since the pressing roller temperature Tp has not yet reached the second temperature setting T2 as a target temperature, the controller 86 energizes the halogen lamp of the second heat source 33 in the pressing roller 30 to generate heat therefrom in step S10G.

If the detected pressing roller temperature Tp is higher than the second temperature setting T2, then since the pressing roller temperature Tp has already reached the second temperature setting T2, the controller 86 de-energizes the halogen lamp of the second heat source 33 in the pressing roller 30 to stop generating heat therefrom in step S10H.

Figure 8:
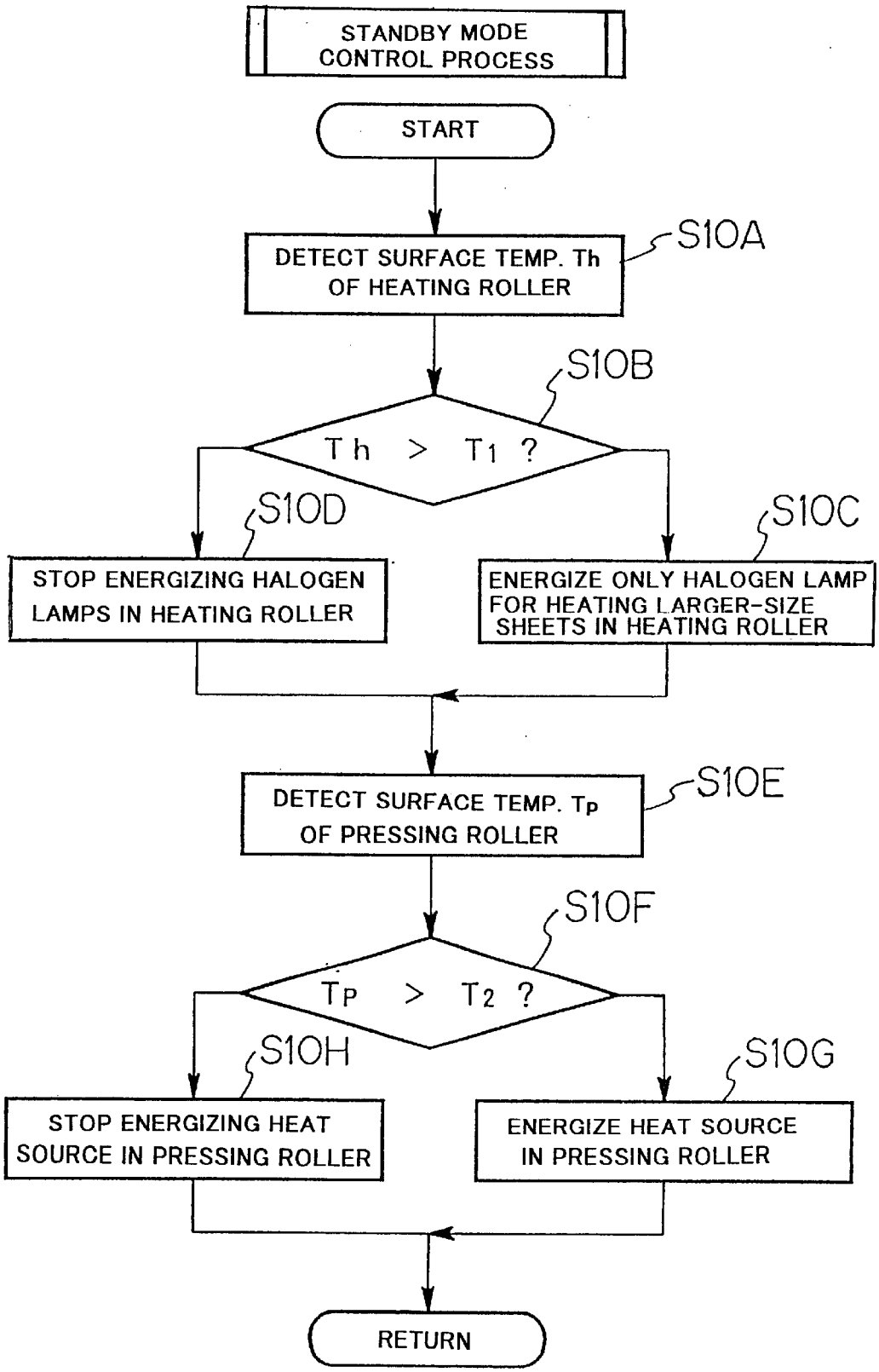
FIG. 8 is a flowchart of the subroutine of a standby mode control process in the main routine shown in FIG. 7.

After having thus controlled the heating of the second heat source 33 in the pressing roller 30 based on the heating roller temperature Tp, controls returns from the standby mode control process shown in FIG. 8 to the main routine shown in FIG. 7.

Subroutine of the Sheet Feed Mode Control Process:

The subroutine of the sheet feed mode control process in step S16 shown in FIG. 7 will be described below with reference to FIG. 9.

When sheet feed mode control process begins, the controller 86 decides whether the size of an unfixed toner sheet fed from the electronic printer is a small size or not in step S16A. If the size of the unfixed toner sheet fed from the electronic printer is not a small size, i.e., if the size of the unfixed toner sheet fed from the electronic printer is a large size, then the controller 86 energizes only the first halogen lamp 32A of the first heat source 32 in the heating roller 34 to generate heat therefrom in step S16B. Thereafter, the controller 86 controls the heating of the second heat source 32 in the pressing roller 30 in step S16C. Specifically, the controller 86 executes a subroutine for controlling the heating of the second heat source 32, which is the same as the processing in steps S10E–S10H in the standby mode control process shown in FIG. 8, in step S16C.

If the size of the unfixed toner sheet fed from the electronic printer is a small size in step S16A, then the controller 86 energizes only the second halogen lamp 32B of the first heat source 32 in the heating roller 34 to generate heat therefrom in step S16D. Thereafter, control goes to the subroutine in step S16C.

After having thus controlling the heating of the heating roller 34 and the pressing roller 30 depending on the size of the sheet being fed, the controller 86 detects the fixing roller temperature Tf with the second thermistor 82 in step S16F, and decides whether the detected fixing roller temperature Tf is higher than the third temperature setting T3 or not in step S16G. If the detected fixing roller temperature Tf is not higher than the third temperature setting T3, then since the detected fixing roller temperature Tf has not yet reached the third temperature setting T3 as a target temperature, the controller 36 energizes the first heat source 32 in the heating roller 34 to generate heat therefrom depending on the size of the sheet being fed in step S16H.

If the detected fixing roller temperature Tf is higher than the third temperature setting T3, then since the detected fixing roller temperature Tf has already exceeded the third temperature setting T3, the controller 36 de-energizes the first heat source 32 in the heating roller 34 to stop generating heat therefrom in step S16I.

Figure 9:
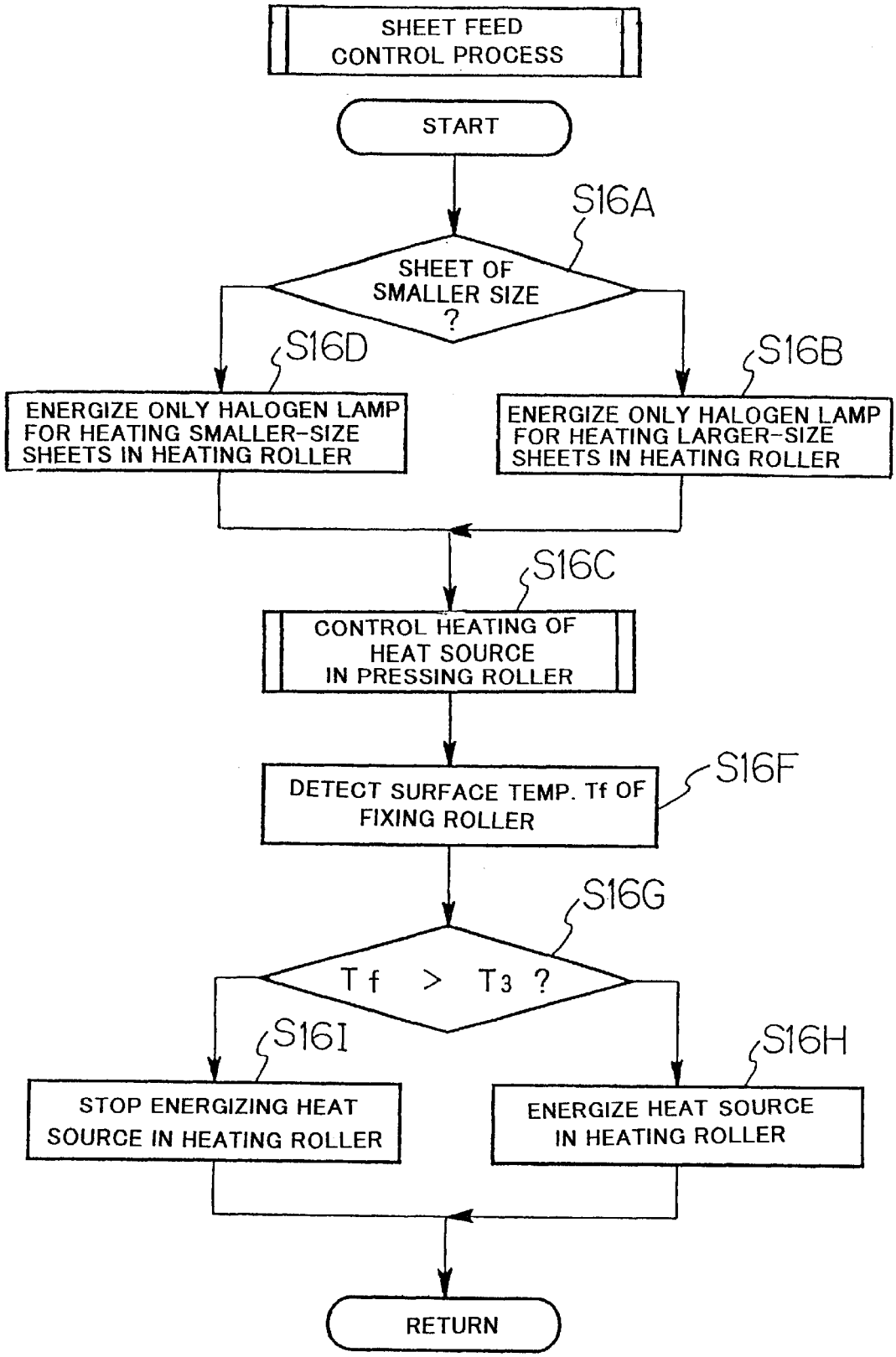
FIG. 9 is a flowchart of the subroutine of a sheet feed mode control process in the main routine shown in FIG. 7.

After having thus controlling the heating of the first heat source 32 in the heating roller 34 based on the fixing roller temperature Tf, controls returns from the sheet feed mode control process shown in FIG. 9 to the main routine shown in FIG. 7.

As described above, according to the control sequence carried out by the controller 86, when the actuating mechanism 52 starts operating, the standby mode control process in which the first heat source 32 disposed in the heating roller 34 is controlled to reach the first temperature setting T1 based on the surface temperature Th of the heating roller 34 as measured by the first thermistor 80 changes to the sheet feed mode control process in which the first heat source 32 is controlled to reach the third temperature setting T3 based on the surface temperature Tf of the fixing roller 28 as measured by the second thermistor 82. The sheet feed mode control process continues insofar as a sheet feed command is supplied from the electronic printer.

Figure 10:
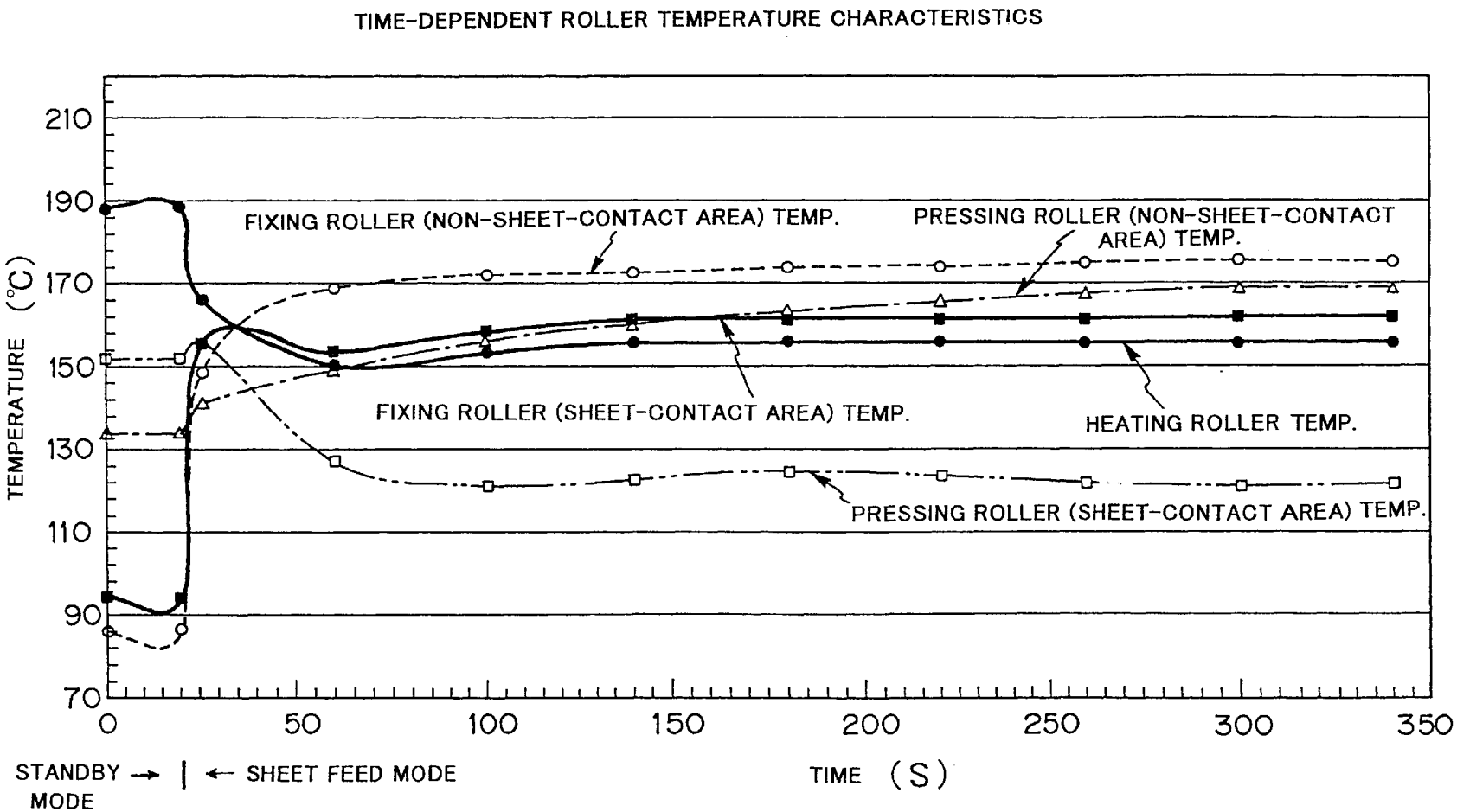
FIG. 10 is a diagram showing the manner in which the temperatures of a fixing belt on the rollers vary when the control sequence is carried out.
Figure 1:
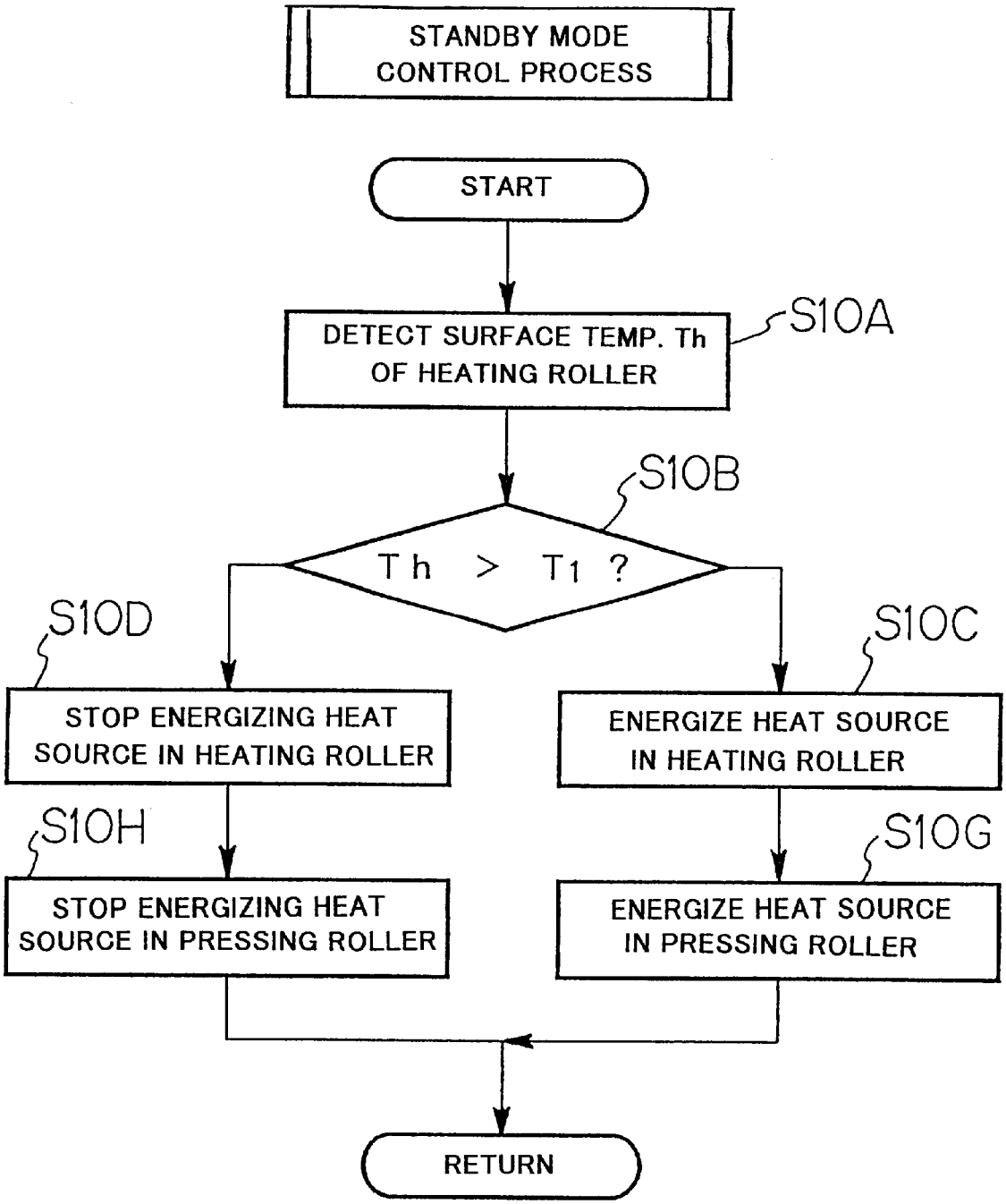
Figure 1:
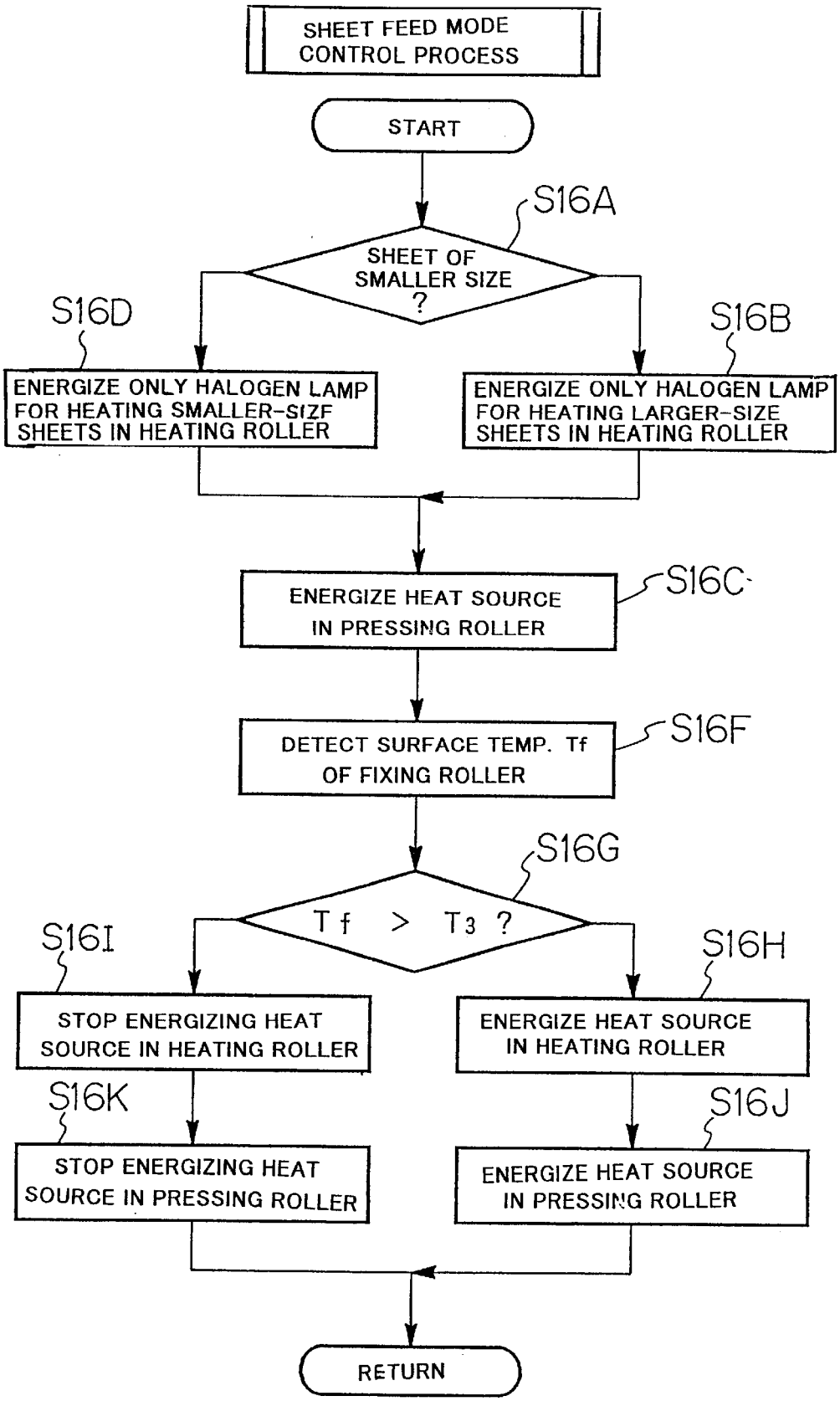

According to the illustrated embodiment, while sheets are being fed into the toner image fixing apparatus 10 in the sheet feed mode, the rollers whose temperatures are to be measured do not change depending on the temperature measured by the first thermistor 80, but the first heat source 32 is controlled always on the basis of the fixing roller temperature. As a result, even when sheets are fed at a high speed and pass through the nipping region highly frequently, depriving the fixing roller 38 of a large amount of heat, the first heat source 32 is controlled to transfer heat from the heating roller 34 through the fixing belt 36 to the fixing roller 28 to make up for the lost heat. Therefore, as shown in FIG. 10, the fixing roller 28 is kept substantially constant in the toner image fixing temperature range at all times. Consequently, even when sheets are fed at a high speed into the toner image fixing apparatus 10, unfixed toner images on the sheets can well be fixed to the sheets with good toner image fixability.

In this embodiment, since the second heat source 33 is disposed in the pressing roller 30 which is one of the rollers positioned across the nipping region, it can supply a sufficient amount of heat to heat the unfixed toner sheet S. As a consequently, even if the speed at which the fixing belt 36 is increased, the nipping region is supplied with a sufficient amount of heat. The toner image fixing apparatus 10 is thus capable of meeting requirements for higher speeds at which to feed sheets into the toner image fixing apparatus 10.

With the second heat source 33 disposed in the pressing roller 30, the size of a sheet being fed into the toner image fixing apparatus 10 in the sheet feed mode is determined, and if the sheet is of a small size, then the second heat source 33 is de-energized to prevent the pressing roller 30 from being heated. Accordingly, the non-sheet-contact area of the fixing belt 36 on the heating roller 36 which is associated with the first thermistor 30 is effectively prevented from increasing its temperature. Even though the temperature of the first heat source 32 in the heating roller 34 is controlled on the basis of the surface temperature of the fixing roller 28 as detected by the second thermistor 82 throughout the sheet feed mode, the surface temperature of the heating roller 34 is prevented from increasing excessively, but the heating roller 34 is heated well with safety.

In the illustrated embodiment, as described above, the first heat source 32 disposed in the heating roller 34 comprises the first halogen lamp 32A for heating larger-size sheets and the second halogen lamp 32B for heating smaller-size sheets. In the standby mode and the sheet feed mode in which larger-size sheets are fed, only the first halogen lamp 32A is energized to heat the heating roller 34. In the sheet feed mode in which smaller-size sheets are fed, only the second halogen lamp 32B is energized to heat the heating roller 34. As a result, the surface temperature of the heating roller 34 is prevented more reliably from increasing excessively for allowing toner images to be fixed to the sheets more stably.

Since the controller 86 effects the standby mode control process, even when the standby mode continues for a long period of time, a fixation readiness time, i.e., the period of time required for the toner image fixing apparatus 10 to become ready for fixing toner images, subsequent to the standby mode can be shortened, so that the operator does not need to wait long before a fixing process begins.

In the above embodiment, the heating roller 34 is positioned substantially upwardly of the fixing roller 28, i.e., the heating roller 34 is angularly positioned with respect to the fixing roller 28 such that the angle formed between the line segment L interconnecting the center of the heating roller 34 and the center of the fixing roller 28 and the reference line B interconnecting the center of the fixing roller 28 and the center of the pressing roller 30 lies in a range from about 105° to about 255°. Therefore, the fixing belt 36 that is trained around the fixing roller 28 and the heating roller 34 is so spaced from the guide plate 44 that the unfixed toner sheet fed on the guide plate 44 will not be brought into contact with the fixing belt 36. Stated otherwise, the fixing belt 36 is disposed in a position outside of a region where the unfixed toner sheet fed on the guide plate 44 possibly passes.

Consequently, no matter how the unfixed toner sheet being fed is curled due to jumping or sagging on account of the speed difference between the toner image fixing apparatus 10 and a preceding toner image transferring apparatus, the unfixed toner image on the upper surface of the unfixed toner sheet is reliably prevented from touching the fixing belt 36, and can be led, without being disturbed, into the rolling contact region between the fixing roller 28 and the pressing roller 30, so that the toner image can reliably be fixed to the sheet by the fixing roller 28.

The fixing roller 28 comprises a resilient roller, and the pressing roller 30 comprises a roller harder than the fixing roller 28. Therefore, even if the fixing roller 28 and the pressing roller 30 are small in diameter, they provide a sufficiently large nipping width in a direction across their axes. As a consequence, the toner image fixing apparatus 10 may be relatively small in size, and sheets can be fed through the toner image fixing apparatus 10 at high speed. The toner image fixing apparatus 10 is thus suitable for use in color printers.

Figure 14:
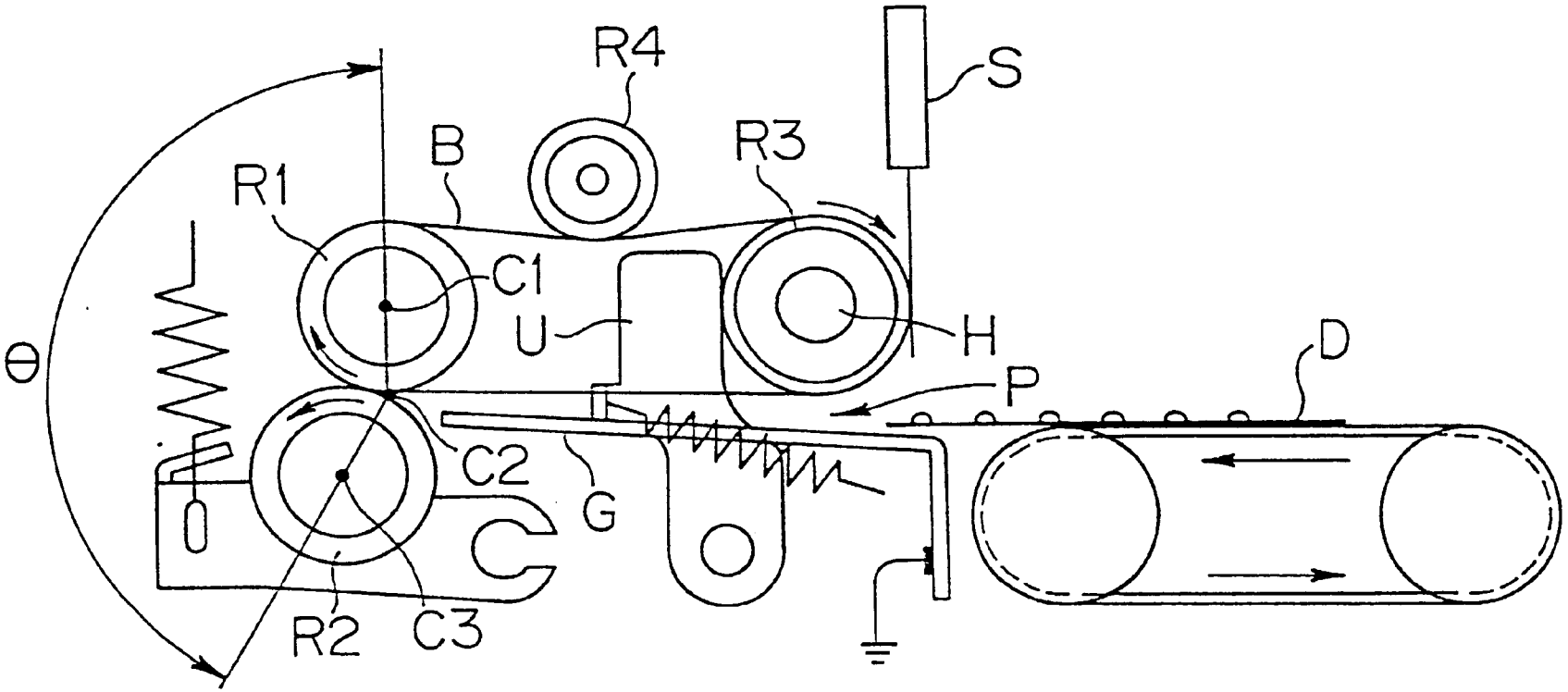
PRIOR ART FIG. 14.
FIG. 14 is a sectional front elevational view of a conventional toner image fixing apparatus.
Figure 15:
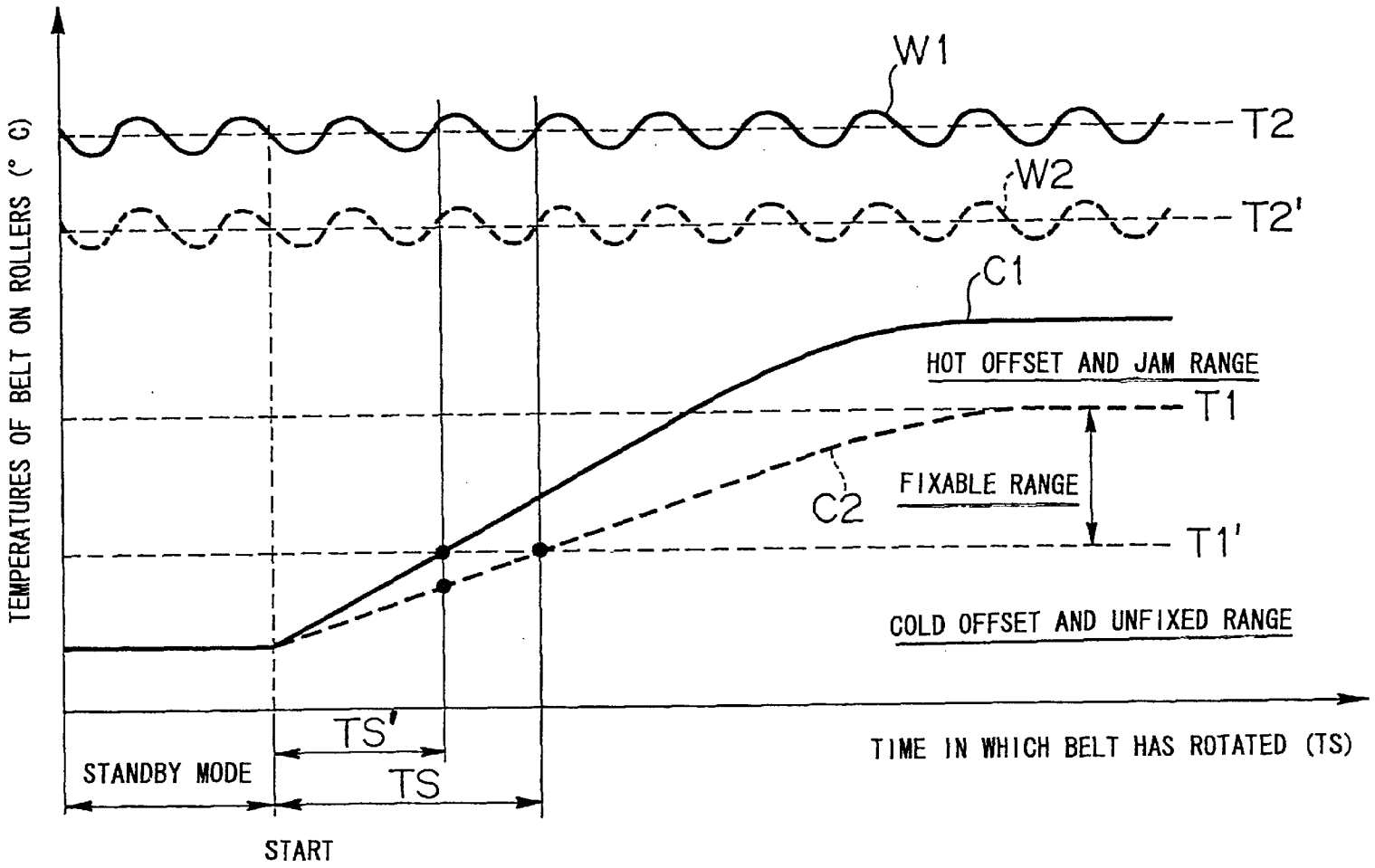
PRIOR ART FIG. 15
FIG. 15 is a diagram showing the manner in which the temperatures of a fixing belt on rollers of the conventional toner image fixing apparatus shown in FIG. 14 vary when a control process is carried out to keep the surface temperature of a heating roller at a constant level.
Figure 16:
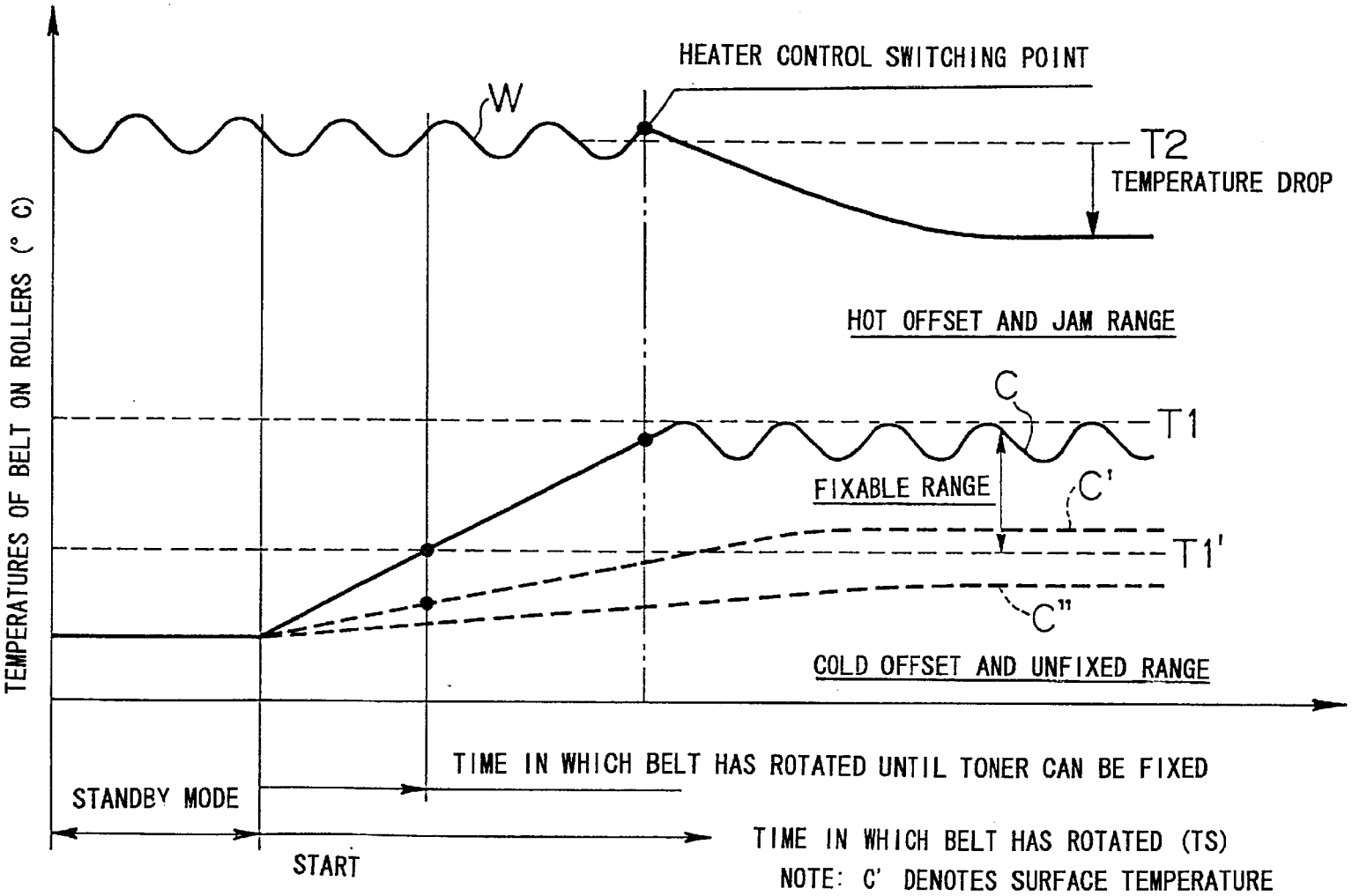
PRIOR ART FIG. 16
FIG. 16 is a diagram showing the manner in which the temperatures of the fixing belt on the rollers of the conventional toner image fixing apparatus shown in FIG. 14 vary when a priority control process is carried out.
Figure 17:
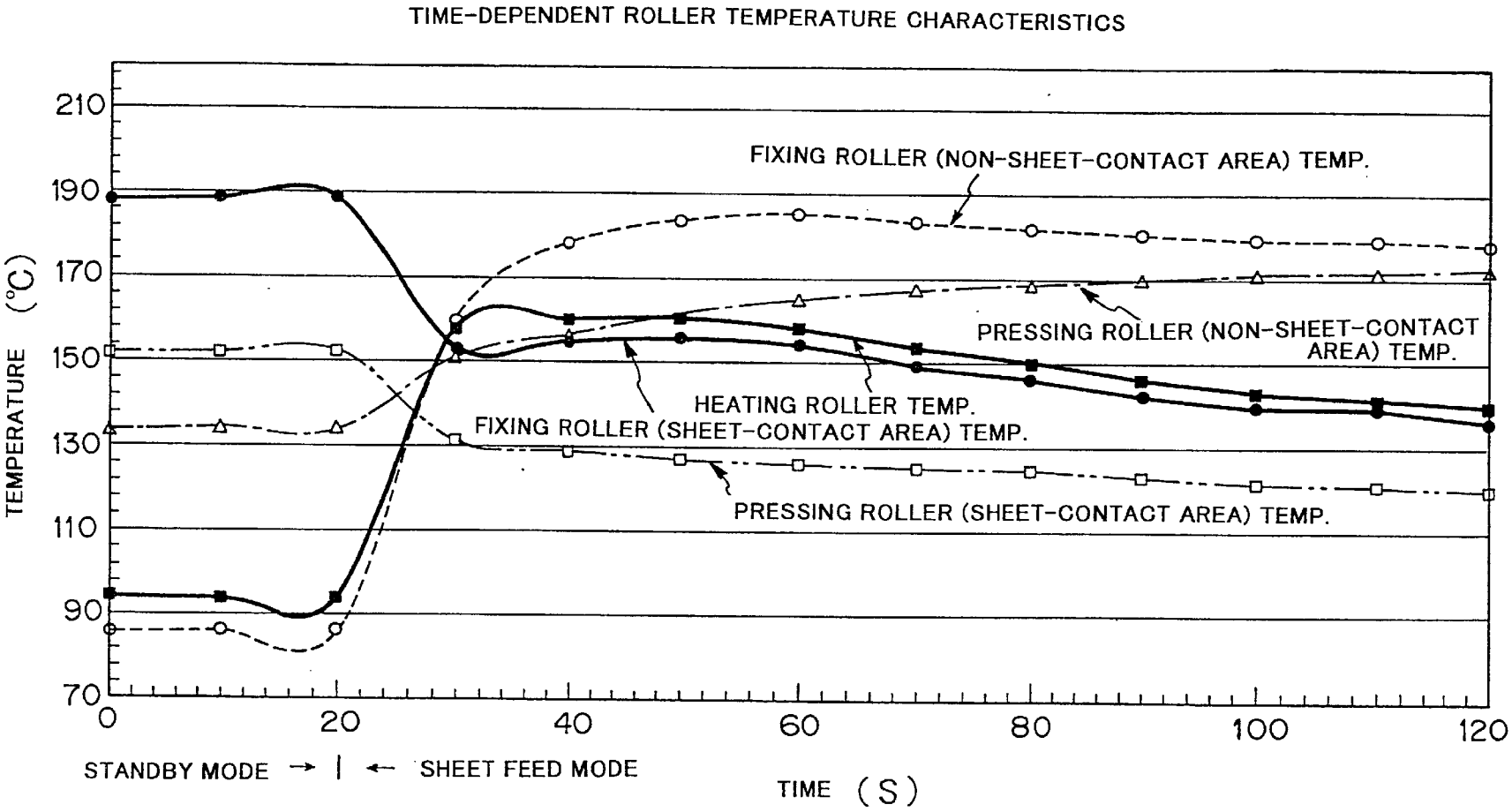
PRIOR ART FIG. 17
FIG. 17 is a diagram showing the manner in which the temperatures of the rollers of the conventional toner image fixing apparatus shown in FIG. 14 vary when the priority control process is carried out while successive sheets are fed into the toner image fixing apparatus.

As described above, inasmuch as the fixing roller 28 positioned above the pressing roller 30 comprises a resilient roller and the pressing roller 30 comprises a roller harder than the fixing roller 28, the fixing roller 28 provides an upwardly concave surface in the nipping region, unlike the conventional structure shown in FIG. 14. The upwardly concave nipping region provided by the fixing roller 28 produces forces tending to separate a sheet carrying a fixed toner image from the fixing belt 36. Even though the toner is carried on the surface of the sheet held in contact with the fixing belt 36, because the sheet can easily be separated from the fixing belt 36 due to the upwardly concave nipping region, the amount of oil applied to the fixing belt 36 by the oil applying roller 38 for preventing sheet offsets and Jams may be relatively small. Actually, the upwardly concave nipping region provided by the fixing roller 28 is effective to avoid sheet offsets and jams between the fixing roller 28 and the pressing roller 30 even without the application of oil to the fixing belt 36 by the oil applying roller 38.

Furthermore, the fixing belt 36 is made of a material having a small heat capacity, trained around the heating roller 34 at a large contact angle, and held in intimate contact with the heating roller 34. As a result, even when sheets are passed at a high speed, i.e., even when a large number of sheets are passed in a unit time, through the nipping region, the temperature necessary to fix toner images to the sheets can reliably be maintained in the rolling contact region between the fixing roller 28 and the pressing roller 30.

In the embodiment, the resilient fixing roller 28 does not house any heater, but the heating roller 34 spaced from the fixing roller 28 houses the heat source 32 therein. Thus, it is possible to sufficiently increase the thickness of the roller sleeve 28B that is made of a heat-resistant resilient material of silicone rubber. Consequently, the nipping width in the rolling contract region can be sufficiently large while at the same time the fixing roller 28 may be relatively small in diameter.

In addition, the one-way clutch 60 disposed between the first driven gear 58 and the fixing roller 28 allows the pressing roller 30, rather than the fixing roller 28, as a primary drive roller for establishing a speed at which the unfixed toner sheet is fed through the nipping region. Therefore, even when the fixing roller 28 is heated in the fixing process and thermally expanded to increase its diameter, since the speed at which the unfixed toner sheet is fed through the nipping region is not established by the fixing roller 28, it is not varied by the thermal expansion of the fixing roller 28, but is maintained at a constant level. Consequently, the fixing belt 36 is maintained at a constant linear velocity to prevent toner images from being displaced or rubbed.

Modifications:

The toner image fixing apparatus 10 has been described as being used in an electronic printer. However, the principles of the present invention are not limited to such an application, but are also applicable to other electronic image forming systems including an electronic facsimile machine, an electrophotographic copying system, etc.

In the above embodiment, the unfixed toner sheet is introduced laterally into the toner image fixing apparatus 10. However, the unfixed toner sheet may be introduced vertically, e.g., upwardly, into the toner image fixing apparatus 10. In such a modification, the pressing roller 30 is disposed laterally of the fixing roller 28, and the heating roller 34 is disposed on one side of the fixing roller 28 which is opposite to the pressing roller 30.

In the above embodiment, the temperatures of the fixing belt 36 on the heating roller 34 and the fixing roller 28 are detected and used for the control of the heating of the heat sources 32, 33. However, the temperatures of the heating roller 34 and the fixing roller 28 may directly be detected and used for the control of the heating of the heat sources 32, 33.

In the above embodiment, the heating or energization of the second heat source 33 disposed in the pressing roller 30 is controlled on the basis of the surface temperature Tp of the pressing roller 30 which is detected by the third thermistor 84, as shown in FIG. 8. According to a first modification, the heating or energization of the second heat source 33 may be controlled on the basis of the surface temperature Th of the heating roller 34 which is detected by the first thermistor 80 or the surface temperature Tf of the fixing roller 28 which is detected by the second thermistor 82, rather than the surface temperature Tp of the pressing roller 30 which is detected by the third thermistor 84.

A standby mode control process and a sheet feed mode control process according to such a first modification will be described below with reference to FIGS. 11 and 12. Those steps shown in FIGS. 11 and 12 which are identical to those shown in FIGS. 8 and 9 will be denoted by identical reference characters, and will not be described in detail below.

In the standby mode control process according to the first modification, as shown in FIG. 11, if the heating roller temperature Th detected by the first thermistor 80 in step S10A is lower than the first temperature setting T1, then the controller 86 energizes the second heat source 33 disposed in the pressing roller 30 to generate heat therefrom in step S10G. If the heating roller temperature Th is higher than the first temperature setting T1, then the controller 86 stops energizing the second heat source 33 to prevent the second heat source 33 from generating heat.

In the standby mode control process according to the first modification, therefore, the processing in steps S10E, S10F shown in FIG. 8 is dispensed with, and hence the third thermistor 84 for detecting the surface temperature of the pressing roller 30 is dispensed with. As a result, the standby mode control process is simplified, and the number of parts used is reduced and the cost of the toner image fixing apparatus is lowered because the third thermistor 84 is dispensed with. Since the third thermistor 84 which is held in contact with the outer circumferential surface of the pressing roller 30 is dispensed with, the outer circumferential surface of the pressing roller 30 is prevented from being damaged by a thermistor, and hence the pressing roller 30 will have a longer service life.

In the sheet feed mode control process according to the first modification, as shown in FIG. 12, if the fixing roller temperature Tf detected by the second thermistor 82 in step S16G is lower than the third temperatures setting T3, then the controller 86 energizes the first heat source 32 disposed in the heating roller 34 to generate heat therefrom in step S16H and then energizes the second heat source 33 disposed in the pressing roller 30 to generate heat therefrom in step S16J. If the fixing roller temperature Tf is higher than the third temperatures setting T3, then the controller 86 stops energizing the first heat source 32 disposed in the heating roller 34 to prevent the first heat source 32 from generating in step S16I and then stops energizing the second heat source 33 disposed in the pressing roller 30 to prevent the second heat source 33 from generating in step S16K.

In as much as the heating of the second heat source 33 is controlled on the basis of the surface temperature Tf of the fixing roller 28, the temperature of the nipping region can be controlled more reliably for improved toner image fixability.

In the first modification, the first thermistor 80 for detecting the surface temperature Th of the heating roller 34 is used to control the heating of the first and second heat sources 32, 33 in the standby mode control process, and the first thermistor 80 is not used, but the second thermistor 82 for detecting the surface temperature Tf of the fixing roller 28 is used, to control the heating of the first and second heat sources 32, 33 in the sheet feed mode control process. Therefore, according to a second modification shown in FIG. 13, the first thermistor 80 is used as a sensor for detecting a temperature failure in the sheet feed mode control process.

Figure 13:
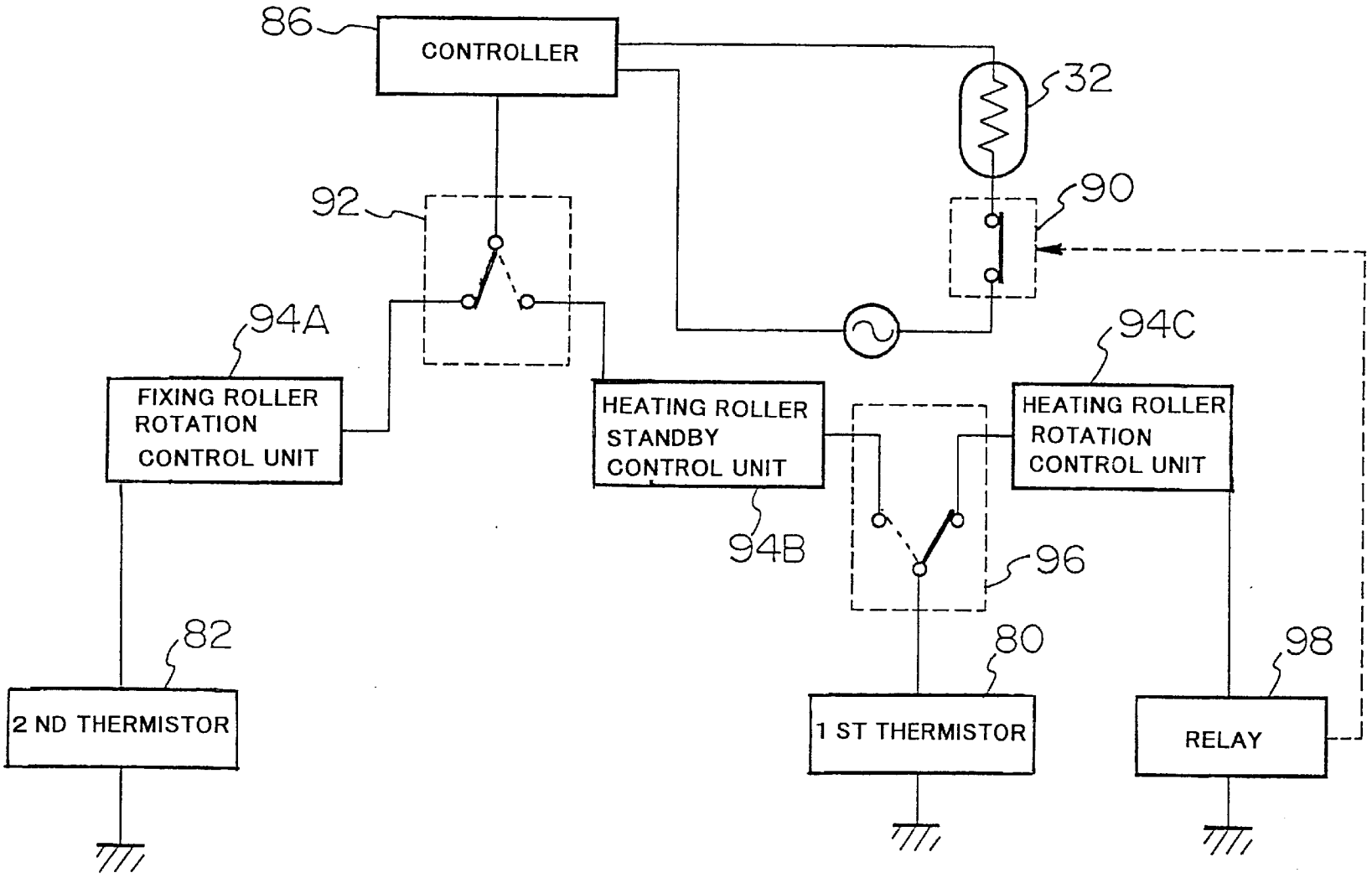
FIG. 13 is a block diagram of a circuit arrangement for detecting a temperature failure according to a second modification for the toner image fixing apparatus.

More specifically, FIG. 13 shows a circuit arrangement according to the second modification. Those parts shown in FIG. 13 which are identical to those shown in FIGS. 1, 3, and 5 are denoted by identical reference characters. As shown in FIG. 13, an emergency shutoff switch 90 is connected in series to the first heat source 32. The second thermistor 82 for detecting the surface temperature Tf of the fixing roller 28 is connected to the controller 86 through a fixing roller rotation control unit 94A. The first thermistor 80 for detecting the surface temperature Th of the heating roller 34 is connected to the controller 86 through a heating roller standby control unit 94B. The fixing roller rotation control unit 94A and the heating roller standby control unit 94B are selectively connected to the controller 86 by a first selector switch 92.

The first thermistor 80 is connected to a heating roller rotation failure control unit 94C through a second selector switch 96. The heating roller standby control unit 94B and the heating roller rotation failure control unit 94C are selectively connected to the first thermistor 80 by the second selector switch 96. If the heating roller rotation failure control unit 94C detects a rotation failure of the heating roller 34 while the heating roller 34 is rotating, then the heating roller rotation failure control unit 94C causes a relay 98 to turn off the emergency shutoff switch 90.

In the standby mode, the first and second selector switches 92, 96 have their movable contacts shifted to the broken-line position. According to the standby mode control process, the controller 86 controls the heating of the first and second heat sources 32, 33 based on the temperature detected by the first thermistor 80. In the sheet feed mode, the movable contacts of the first and second selector switches 92, 96 are shifted to the solid-line position. According to the sheet feed mode control process, the controller 86 controls the heating of the first and second heat sources 32, 33 based on the temperature detected by the second thermistor 82.

In the sheet feed mode, the first thermistor 80 is connected to the heating roller rotation failure control unit 94C through the second selector switch 96. Therefore, the heating roller rotation failure control unit 94C can detect a temperature failure of the heating roller 34 based on the temperature detected by the first thermistor 80. For example, if the surface temperature Th of the heating roller 34 exceeds an allowable safety range, then the heating roller rotation failure control unit 94C applies a control signal to the relay 98 to cause the relay 98 to turn off the emergency shutoff switch 90 for thereby cutting off the supply of an electric current to the first heat source 33 in the heating roller 34. The heating roller 34 is thus prevented from being overheated for safety.

A circuit arrangement of the second heat source 33 is omitted from illustration in FIG. 13.

In the first modification, the first and second heat sources 32, 33 are energized for the same period of time. However, the period of time for which the first heat source 33 is energized may be made longer than the period of time for which the first heat source 32 is energized, using a timer, a latch, etc. This is because in general the heating capacity of the second heat source 33 disposed in the pressing roller 30 is smaller than the heating capacity of the first heat source 32 disposed in the heating roller 34.

According to the present invention as described above, the toner image fixing apparatus can fix toner images to unfixed toner sheets with good toner image fixability even when the unfixed toner sheets are fed at an increased speed into the toner image fixing apparatus.

Furthermore, the toner image fixing apparatus is capable of holding the surface temperature of the fixing roller substantially in a toner image fixing temperature range even when a sheet with an unfixed toner image carried thereon is fed at an increased speed.

The toner image fixing apparatus can fix a toner image to an unfixed toner sheet while preventing the surface temperature of the fixing roller from increasing excessively even when the unfixed toner sheet is fed at an increased speed.

The toner image fixing apparatus can fix a toner image to an unfixed toner sheet while holding the surface temperature of the fixing roller substantially in a toner image fixing temperature range even when the unfixed toner sheet is fed at an increased speed.

Although certain preferred embodiments of the present invention have been shown and described in detail, it should be understood that various changes and modifications may be made therein without departing from the scope of the appended claims.

What is claimed is:

1. An apparatus for fixing a toner image to a sheet, comprising:

a fixing roller;

a pressing roller urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller;

a heating roller disposed on one side of said fixing roller opposite to said pressing roller;

a first heating source disposed in said heating roller for heating said heating roller;

an endless heat transfer belt trained around said heating roller and said fixing roller for transferring heat from said first heating source to heat the unfixed toner image on said sheet when said sheet passes through said rolling contact region; and a second heating source disposed in said pressing roller for heating said pressing roller; and a control device for energizing said first heating source and said second heating source when the apparatus is in a standby mode, and energizing said first heating source when the apparatus is in a sheet feed mode, and energizing said second heating source when the apparatus is in the sheet feed mode only if said sheet is of a size larger than a predetermined size, wherein said control device includes a first detecting device for detecting a surface temperature of said heating roller, a second detecting device for detecting a surface temperature of said fixing roller, and a third detecting device for detecting a surface temperature of said pressing roller;

said control device further includes a controller for controlling said first heating source based on the surface temperature detected by said first detecting device and controlling said second heating source based on the surface temperature detected by said third detecting device when the apparatus is in said standby mode, and controlling said first heating source based on the surface temperature detecting by said second detecting device when the apparatus is in said sheet feed mode.

2. The apparatus according to claim 1, further comprising a decision device for deciding whether the apparatus is in said standby mode or said sheet feed mode, said decision device including a determining device for determining that the apparatus is in said sheet feed mode when a sheet feed command is supplied, and that the apparatus is in said standby mode when a sheet feed command is not supplied.

3. An apparatus for fixing a toner image to a sheet, comprising:

a fixing roller;

a pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller;

a heating roller disposed on one side of said fixing roller opposite to said pressing roller;

a first heating source disposed in said heating roller for heating said heating roller;

an endless heat transfer belt trained around said heating roller and said fixing roller for transferring heat from said first heating source to heat the unfixed toner image on said sheet when said sheet passes through said rolling contact region; and a second heating source disposed in said pressing roller for heating said pressing roller;

a decision device for determining the size of said sheet; and a control device for energizing said first heating source and said second heating source when the apparatus is in a standby mode, and energizing said first heating source when the apparatus is in a sheet feed mode, energizing said second heating source when the apparatus is in the sheet feed mode if said sheet is of a size larger than a predetermined size as determined by said decision device, and de-energizing said second heating source when the apparatus is in the sheet feed mode if said sheet is of a size smaller than said predetermined size as determined by said decision device, wherein said control device includes a first detecting device for detecting a surface temperature of said heating roller, a second detecting device for detecting a surface temperature of said fixing roller, and a third detecting device for detecting a surface temperature of said pressing roller;

said control device further includes a controller for controlling said first heating source based on the surface temperature detected by said first detecting device and controlling said second heating source based on the surface temperature detected by said third detecting device when the apparatus is in said standby mode, and controlling said first heating source based on the surface temperature detecting by said second detecting device when the apparatus is in said sheet feed mode.

4. The apparatus according to claim 3, further comprising a decision device for deciding whether the apparatus is in said standby mode or said sheet feed mode, said decision device including a determining device for determining that the apparatus is in said sheet feed mode when a sheet feed command is supplied, and that the apparatus is in said standby mode when a sheet feed command is not supplied.

5. An apparatus according to claim 1, wherein said first heating source comprising a first heater for heating said heating roller when the sheet is of a size larger than a predetermined size and a second heater for heating said heating roller when the sheet is of a size smaller than said predetermined size.

6. The apparatus according to claim 5, wherein said first heater and said second heater include halogen lamps, respectively.

7. The apparatus according to claim 5, wherein said second heating source includes a halogen lamp.

8. The apparatus according to claim 5, further comprising a control device for energizing said first heater and said second heating source when the apparatus is in a standby mode, and energizing said first heating source when the apparatus is in a sheet feed mode such that said first heater is energized if said sheet is of the size larger than said predetermined size, and said second header is energized if said sheet is of the size smaller than said predetermined size.

9. The apparatus according to claim 8, wherein said control device includes a heater driver for energizing only said first heater if said sheet is of the size larger than said predetermined size and energizing only said second heater if said sheet is of the size smaller than said predetermined size.

10. The apparatus according to claim 5, further comprising a decision device for determining the size of said sheet, said control device including a heater driver for energizing said first heater when the apparatus is in said sheet feed mode if said sheet is of the size larger than said predetermined size as determined by said decision device, and energizing said second heater when the apparatus is in said sheet feed mode if said sheet is of the size smaller than said predetermined size as determined by said decision device.

11. A method of fixing a toner image to a sheet, comprising utilizing an apparatus having a fixing roller having a resilient outer layer, a pressing roller having an outer layer with hardness higher than that of said outer layer of said fixing roller, said pressing roller normally urged toward said fixing roller for pressing a sheet with an unfixed toner image carried on a surface thereof against said fixing roller to fix the unfixed toner image to said sheet when said sheet passes in one direction through a rolling contact region between said fixing roller and said pressing roller, a heating roller disposed on one side of said fixing roller opposite to said pressing roller, a first heating source disposed in said heating roller for heating said heating roller, said first heating source including a first heater for heating said heating roller when the sheet is of a size larger than a predetermined size and a second heater for heating said heating roller when the sheet is of a size smaller than said predetermined size, an endless heat transfer belt trained around said heating roller and said fixing roller for transferring heat from said first heating source to heat the unfixed toner image on said sheet when said sheet passes through said rolling contact region, and a second heating source disposed in said pressing roller for heating said pressing roller;

deciding whether said apparatus is in a sheet feed mode or not;

determining the size of said sheet if said apparatus is in the sheet feed mode;

energizing said first heater of the first heating source and energizing said second heating source when said first heater of the first heating source is energized, if the size of said sheet is larger than a predetermined size; and energizing said second heater of the first heating source if the size of said sheet is smaller than said predetermined size.

12. The method according to claim 11, further comprising a step of de-energizing said second heating source when said second heater of the first heating source is energized.

13. An apparatus according to claim 3, wherein said first heating source comprising a first heater for heating said heating roller when the sheet is of a size larger than a predetermined size and a second heater for heating said heating roller when the sheet is of a size smaller than said predetermined size.

14. The apparatus according to claim 13, wherein said first heater and said second heater include halogen lamps, respectively.

15. The apparatus according to claim 13, wherein said second heating source includes a halogen lamp.

16. The apparatus according to claim 13, further comprising a control device for energizing said first heater and said second heating source when the apparatus is in a standby mode, and energizing said first heating source when the apparatus is in a sheet feed mode such that said first heater is energized if said sheet is of the size larger than said predetermined size, and said second heater is energized if said sheet is of the size smaller than said predetermined size.

17. The apparatus according to claim 16, wherein said control device includes a heater driver for energizing only said first heater if said sheet is of the size larger than said predetermined size and energizing only said second heater if said sheet is of the size smaller than said predetermined size.

18. The apparatus according to claim 13, further comprising a decision device for determining the size of said sheet, said control device including a heater driver for energizing said first heater when the apparatus is in said sheet feed mode if said sheet is of the size larger than said predetermined size as determined by said decision device, and energizing said second heater when the apparatus is in said sheet feed mode if said sheet is the size smaller than said predetermined size as determined by said decision device.

* * * * *